US009174780B2

(12) United States Patent
Gelardi et al.

(10) Patent No.: US 9,174,780 B2
(45) Date of Patent: Nov. 3, 2015

(54) SINGLE PIECE CONTAINER FOR SECURING AN INSERT CARD

(75) Inventors: John A. Gelardi, Midlothian, VA (US); Elisabeth Gelardi, legal representative, Midlothian, VA (US); Ryan A. Bailey, Richmond, VA (US); Sara Falcon, Richmond, VA (US)

(73) Assignee: WestRock MWV, LLC, Norcross, GA (US)

( * ) Notice: Subject to any disclaimer, the term of this patent is extended or adjusted under 35 U.S.C. 154(b) by 150 days.

(21) Appl. No.: 13/701,428

(22) PCT Filed: Jun. 1, 2011

(86) PCT No.: PCT/US2011/038828

§ 371 (c)(1),
(2), (4) Date: Nov. 30, 2012

(87) PCT Pub. No.: WO2011/153290

PCT Pub. Date: Dec. 8, 2011

(65) Prior Publication Data

US 2013/0068651 A1 Mar. 21, 2013

Related U.S. Application Data

(60) Provisional application No. 61/350,158, filed on Jun. 1, 2010.

(51) Int. Cl.

| | |
|---|---|
| ***B65D 83/04*** | (2006.01) |
| ***B65D 55/02*** | (2006.01) |
| ***B65D 25/00*** | (2006.01) |

(52) U.S. Cl.

CPC ..... *B65D 55/02* (2013.01); *B65D 25/00* (2013.01); *B65D 83/0463* (2013.01); *B65D 2203/06* (2013.01)

(58) Field of Classification Search

CPC .... B65D 83/0463; B65D 55/02; B65D 25/00; B65D 2203/06; B65D 75/5833; B65D 2215/02; B65D 2583/0468

USPC ..... 206/1.5, 528–540, 468; 229/125.125, 229/102; 220/345.3, 324, 326

See application file for complete search history.

(56) References Cited

U.S. PATENT DOCUMENTS 4,120,400 A 10/1978 Kotyuk
4,364,488 A * 12/1982 Anjou ..... 220/281

(Continued)

FOREIGN PATENT DOCUMENTS

WO WO2009058979 5/2009
WO WO2009055547 6/2010

*Primary Examiner* — Mickey Yu
*Assistant Examiner* — Chun Cheung
(74) *Attorney, Agent, or Firm* — WestRock Intellectual Property Group

(57) ABSTRACT

Disclosed is a single-piece container adapted to receive and secure an insert card. The container is a generally rectangular, relatively flat structure having an interior chamber defined by a top surface, a bottom surface, one open end, and one closed end. The container is formed from a blow molding process and adapted to receive an insert card. The container further comprises locking elements that work in cooperation with the insert card to secure the insert card within the interior chamber such that it can not be removed without manipulation of the locking elements. The material comprising the container can be a clear plastic such that optical scan codes present on an insert card contained within the container can be read through the container.

13 Claims, 35 Drawing Sheets

(56) References Cited

U.S. PATENT DOCUMENTS

| | | | | |
|---|---|---|---|---|
| 5,275,291 | A * | 1/1994 | Sledge | 206/531 |
| 6,047,829 | A * | 4/2000 | Johnstone et al. | 206/531 |
| 6,641,031 | B2 * | 11/2003 | Evans et al. | 229/102 |
| 8,132,671 | B2 | 3/2012 | Hession | |
| 8,251,218 | B2 | 8/2012 | Gelardi | |
| 2003/0085262 | A1 * | 5/2003 | Evans et al. | 229/102 |
| 2004/0050748 | A1 * | 3/2004 | Ehrlund | 206/538 |
| 2007/0023317 | A1 | 2/2007 | Brozell et al. | |
| 2009/0045078 | A1 * | 2/2009 | Gelardi et al. | 206/1.5 |
| 2010/0243509 | A1 | 9/2010 | Gelardi | |
| 2011/0226765 | A1 | 9/2011 | Gelardi | |
| 2012/0160724 | A1 | 6/2012 | Gelardi | |
| 2012/0160726 | A1 | 6/2012 | Gelardi | |
| 2012/0199581 | A1 | 8/2012 | Matsuba et al. | |
| 2012/0217183 | A1 | 8/2012 | Loftin et al. | |
| 2012/0267261 | A1 | 10/2012 | Gelardi | |

* cited by examiner 70
60
50
40
30
20
10
SOT
SOT
SOT
SOT
TWO
TWO
TWO 20
20
20
D1
D2
60
60
60

5h
4h
4h
2h
2h
2h
2h
2h
2h
2h
2h

SINGLE PIECE CONTAINER FOR SECURING AN INSERT CARD

CROSS REFERENCE STATEMENT

This application is a National Phase application of PCT Application PCT/US11/038828 filed Jun. 1, 2011, which claims the benefit of U.S. Provisional Application No. 61/350,158, filed Jun. 1, 2010, each of which is incorporated herein by reference in its entirety.

SUMMARY OF THE INVENTION

Disclosed is a blow-molded container adapted to receive and secure an insert card that may be one or more single piece(s). The container is a generally rectangular, relatively flat structure having an interior chamber defined by a top surface, a bottom surface, one open end, and one closed end. The container may be formed from a blow molding process and adapted to receive one or more insert card(s). The container may further comprise locking elements that work in cooperation with the one or more insert card(s) to secure the one or more insert card(s) within the interior chamber such that it can not be removed without manipulation of the locking elements.

The locking elements may include: (i) a locking stop element that slopes inward and rearward from the interior of the top surface of the container into the interior chamber and then vertically back to the interior of the top surface of the container, the locking stop element generally may be positioned near the closed end of the container and generally centered with respect to the width of the container; (ii) at least one locking guide that may indent from the top surface of the container into the interior chamber and may be positioned lengthwise between the locking stop element and the closed end of the container; (iii) an indented support platform that may indent from the bottom surface of the container into the interior chamber and may be (a) positioned lengthwise between the locking stop element and the closed end of the container, and (b) generally may be centered with respect to the width of the container; and (iv) a locking release button may be positioned lengthwise between the locking stop element and the closed end of the container wherein a down ward force applied to the locking release button may cause the deflection of the at least one locking guide further into the interior chamber of the container.

The container further may include at least one retaining element that may slope inward and rearward from the interior of the top surface of the container into the interior chamber and then vertically back to the interior of the top surface of the container, the retaining element generally positioned near the open end of the container and against one side with respect to the width of the container.

The material comprising the container may be a polyvinylchloride (PVC), a polypropylene (PP), a polyethylene terephthalate (PET), a re-processed polyethylene terephthalate (RPET), or a glycolised polyethylene terephthalate (PETG).

In addition, the material comprising the container may also be a clear plastic such that optical scan codes present on an insert card contained within the container may be read through the container.

The word "mirror" or "mirrors" used herein refers to the relationship between the opposite sides of a non-flat sheet or panel member wherein one of the opposite sides defines a three-dimensional configuration similar (if not identical) but complementary to the three-dimensional configuration defined by the other of the opposite sides. For example, one of a pair of mirroring sides curves concavely while the other curves convexly such that the convex side is allowed to substantially fit, or otherwise nest, in the concave side. Stated differently, the word "mirror" or "mirrors" means "having a shape or configuration complementary to that of" or "defining a three-dimensional configuration complementary to that defined by". For example, "a raised locking element mirrors a cavity in that element" means that the raised locking element has a shape complementary to the shape defined by the cavity in that element."

BRIEF DESCRIPTION OF THE DRAWINGS

FIG. 27 is a perspective view of a two-piece container with an insert card and an electronic component in a closed position.

FIG. 30 is an alternate exploded perspective view of the two piece container of FIG. 29.

FIG. 32 is a perspective view of a single piece container of FIG. 31 in its unassembled form.

FIG. 33 is a perspective view of a single piece container of FIG. 31 in a partially assembled form.

DETAILED DESCRIPTION OF THE PREFERRED EMBODIMENTS

Disclosed is a seamless integrally formed container that may be produced using a blow molding process. It may be a single piece construction container with the only opening in the front of the structure. However, it is to be understood one or more openings may exist in the container as well. The container provides elements for locking, unlocking and retaining an insert card within the container.

A single piece construction removes the need to assemble two or more components to form the container thereby reducing the complexity of the manufacturing process.

The container may be produced from a recycled material such as PET that is and may be further recycled when the package is no longer of use to the consumer. The container may be formed from a material that allows the structure to be flexible and/or semi ridged. Preferably the structure is light weight and having one or more thin walls compared to an injection molded equivalent container.

Specific materials for the container can include polyvinylchloride (PVC), polypropylene (PP), polyethylene terephthalate (PET), re-processed polyethylene terephthalate (RPET), and glycolised polyethylene terephthalate (PETG).

Unlocking of the insert card may be achieved by applying a force that flexes the locking area inward. The inward motion/state the unlocking elements of the container deflect an element of the insert card past a locking feature present within the container. With the locking feature in a deflect state the insert card then can be gripped and pulled from the package. It is to be understood that package may be designed to open from force supplied from the top of the package or it may be designed to open using force applied from the sides of the container or it may be opened from force supplied from the bottom of the container or any combination of these opening features. It is to be understood that the package may be designed such that other areas of pressure or any combination of these areas may be used to open the package and that the design of such package may be based on manufacturing preferences.

The container may be formed from a clear material allowing the consumer to view the insert card and its contents when the card is secured within the container. A clear material also allows bar code scanners or other optical readers to read bar codes and or marking on the insert card when it is secured within the container. It is to be understood that the material may be shaded or colored based on manufacturing preferences. A darker, colored or treated outer shell may provide protection for medicines sensitive to light. It is also understood that a slot may be formed in the shell such that the bar code may show through and be accessible for scanning.

Figure 1:
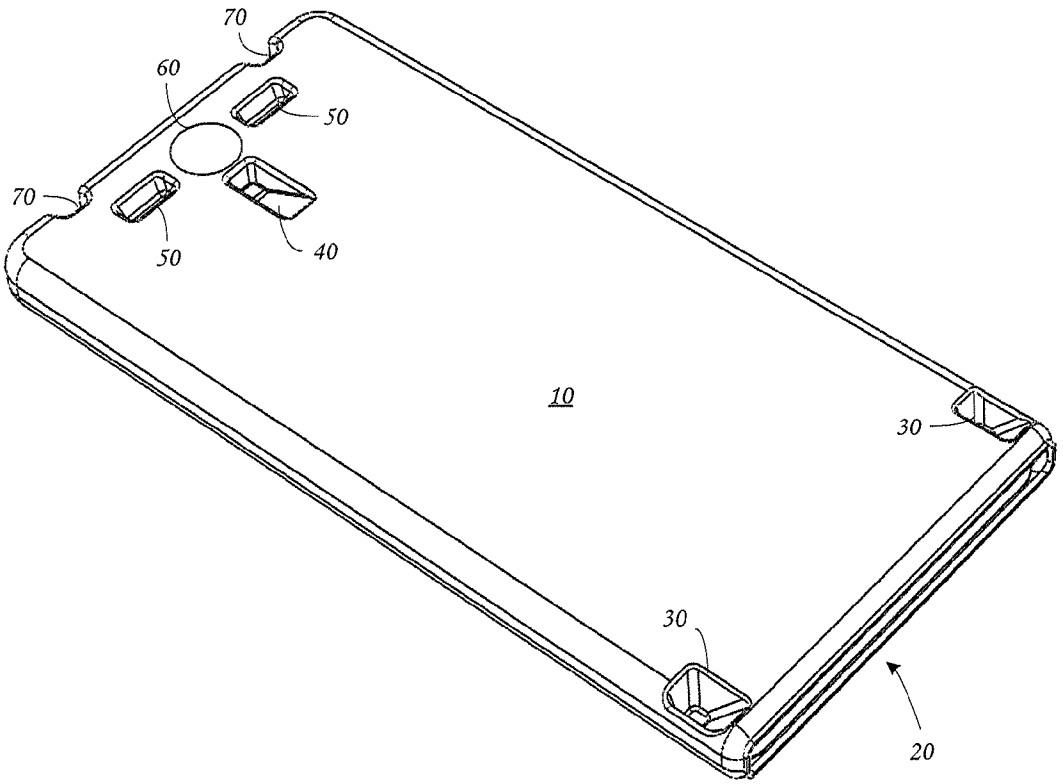
FIG. 1 is a perspective top view of a single piece container according to an embodiment of the invention.

FIG. 1 is a perspective top view of a single piece container 10 according to an embodiment of the invention. The container 10 is generally flat and rectangular defining an interior chamber accessible by an opening 20 at one end of the container 10. It is to be understood that one or more opening(s) may be positioned at opening 20. There are multiple elements that assist in the insertion and retention of an insert card. In this view showing the top surface of the container 10, a pair of retaining elements 30 are shown positioned near the opening 20 and serve to prevent an insert card from being completely removed once it has been inserted into the container 10. It is to be understood that one or more retaining element(s) 30 may be used. Also shown (from the outside) is a locking stop element 40 that is positioned toward the closed end of the container 10 and is generally centered with respect to the width of the container 10. It is to be understood that one or more locking stop elements may be used. It is to be further understood that the locking stop elements may be located to the sides of the package should manufacturing preferences dictate. The locking stop element 40 may slope inward and away from the opening 20 before returning to the top surface at a substantially perpendicular angle. It is to be understood that this element may be adjusted based on manufacturing preferences. A pair of locking guides 50 may assist in positioning the insert card within the interior chamber of the container 10 and are described in more detail below. It is to be understood that one or more locking guide(s) 50 may be used in container 10. One or more locking release buttons 60 may assist in operating the locking and unlocking components when a sufficient downward pressure is applied thereto. It is to be understood that one or more locking release buttons may be used. It is also to be understood that a locking release button may be replaced with an opening in the outer package to allow the user to unlock the blister by asserting pressure in the appropriate open area and/or directly on the locking element of the blister or inner tray. Lastly, a pair of insert card stops 70 may help define the position of the insert card when fully inserted and secured in place. It is to be understood that one or more insert card stop(s) 70 may be used.

Figure 2:
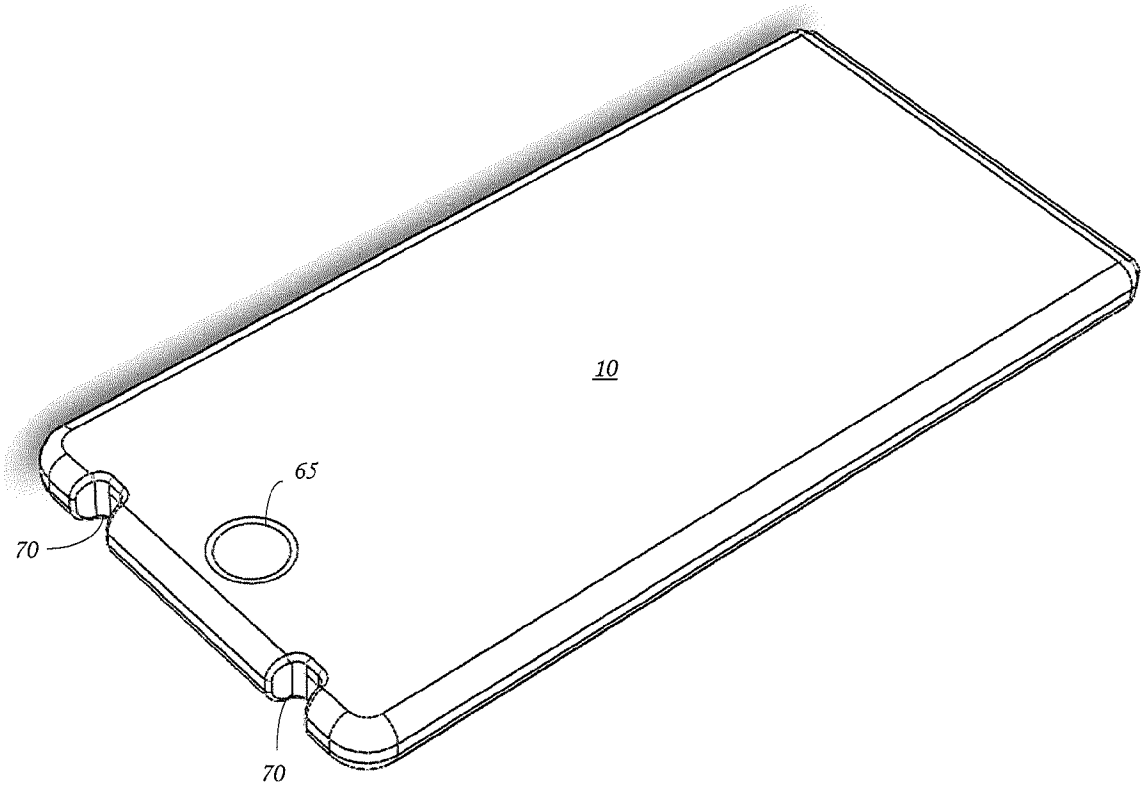
FIG. 2 is a perspective bottom view of a single piece container according to an embodiment of the invention.

FIG. 2 is a perspective bottom view of a single piece container 10 according to an embodiment of the invention. In this view showing the bottom surface of the container 10, an indent support platform 65 is shown that generally corresponds with and is positioned below the locking release button 60 on the top surface. The locking release button 60 can be pushed toward the interior of the container 10 to help disengage the insert card from the locking elements.

Figure 3:
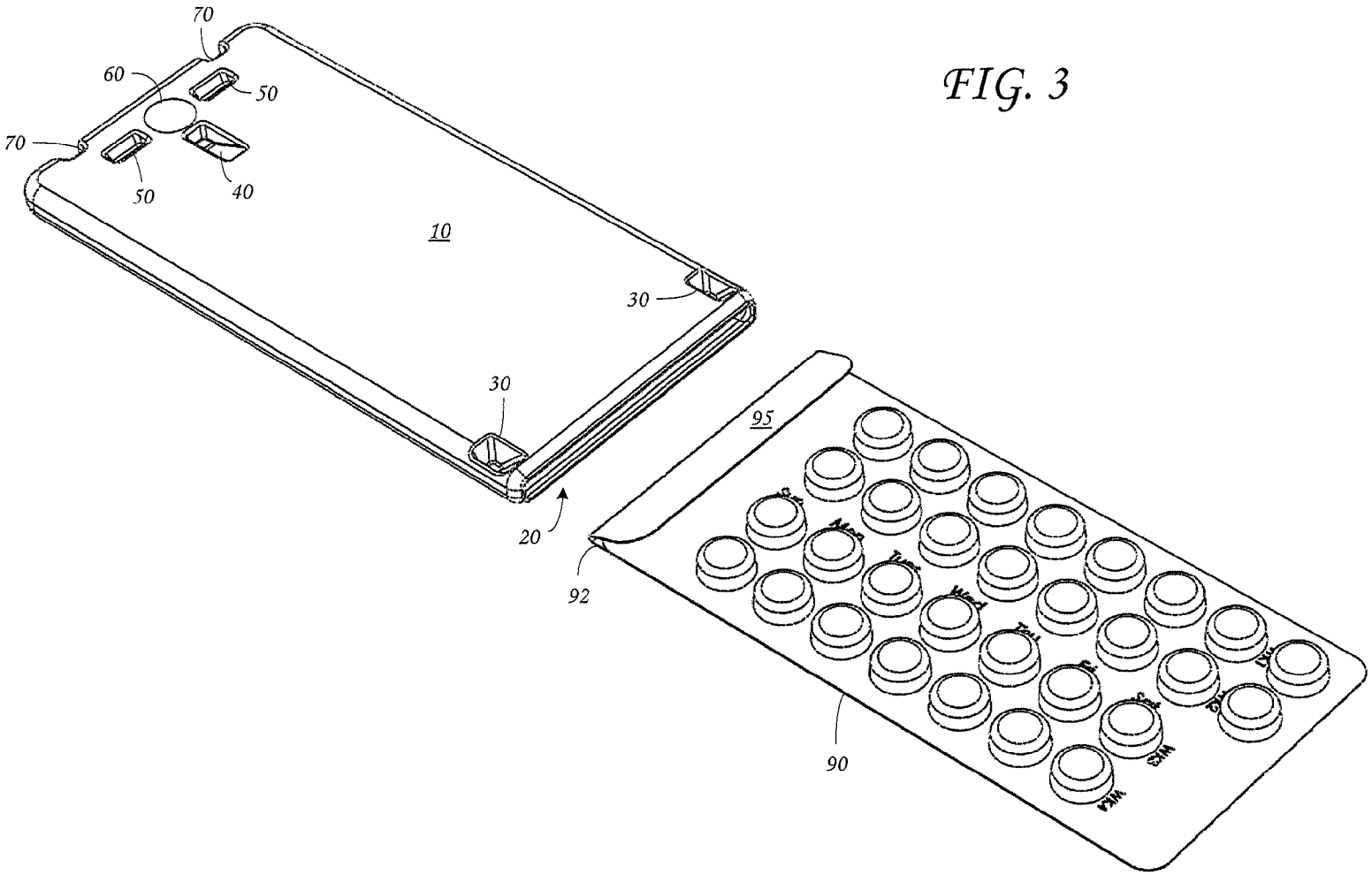
FIG. 3 is a perspective top view of a single piece container and insert card according to an embodiment of the invention.

FIG. 3 is a perspective top view of a single piece container 10 and insert card 90 according to an embodiment of the invention. The container 10 is pictured as in FIG. 1. The insert card 90 is of a blister pack type in this illustration. The insert card 90 includes an insert card flap 95 that is a folded portion on the leading edge of the insert card 90. To prevent the insert card flap 95 from being folded completely atop the insert card 90 there may be an insert card bump 92 that limits how far the insert card flap 95 can be folded back over the insert card 90. It is to be understood that one or more insert card flaps and one or more insert card bumps may be used. It further is to be understood that a bump on the outside of the insert card flap 95 facing towards the container rather than the blister when the flap 95 is in a folded position may interact with the locking element 40 of the container itself and thus eliminate the risk of the insert card flap 95 folding too close to the body of the blister. This helps retain the insert card 90 in a proper alignment with respect to the various locking and unlocking components of the container 10.

Figure 4:
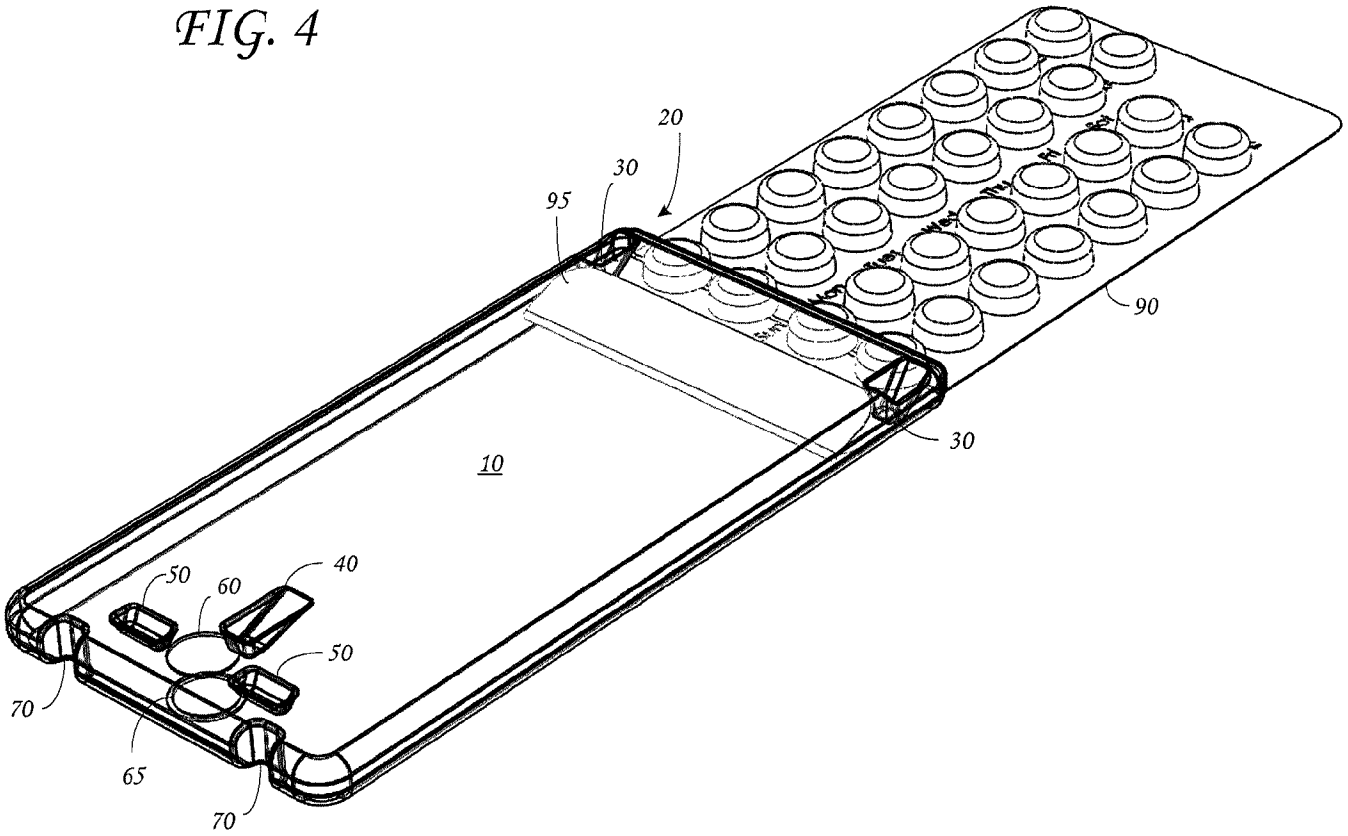
FIG. 4 is another perspective top view of a single piece container showing the insert card partially inserted into the container according to an embodiment of the invention.

FIG. 4 is another perspective top view of a single piece container 10 showing the insert card 90 partially inserted into the container opening 20 according to an embodiment of the invention. The insert card 90 may be adapted to fit within opening 20 such that the insert card flap 95 is compressed as it slides over the retaining elements 30. Once the leading edge of the insert card 90 clears the retaining elements 30 of container 10, the insert card flap 95 may spring into its normal position within the interior chamber of the container 10. The insert card 90 may be kept within the interior chamber by retaining elements 30 that contact the insert card flap 95 when the insert card 90 is pulled out. Since the insert card flap 95 is folded toward the retaining elements 30 it can not unfold since there is insufficient space. Thus, the insert card is kept within the container 10.

Figure 5:
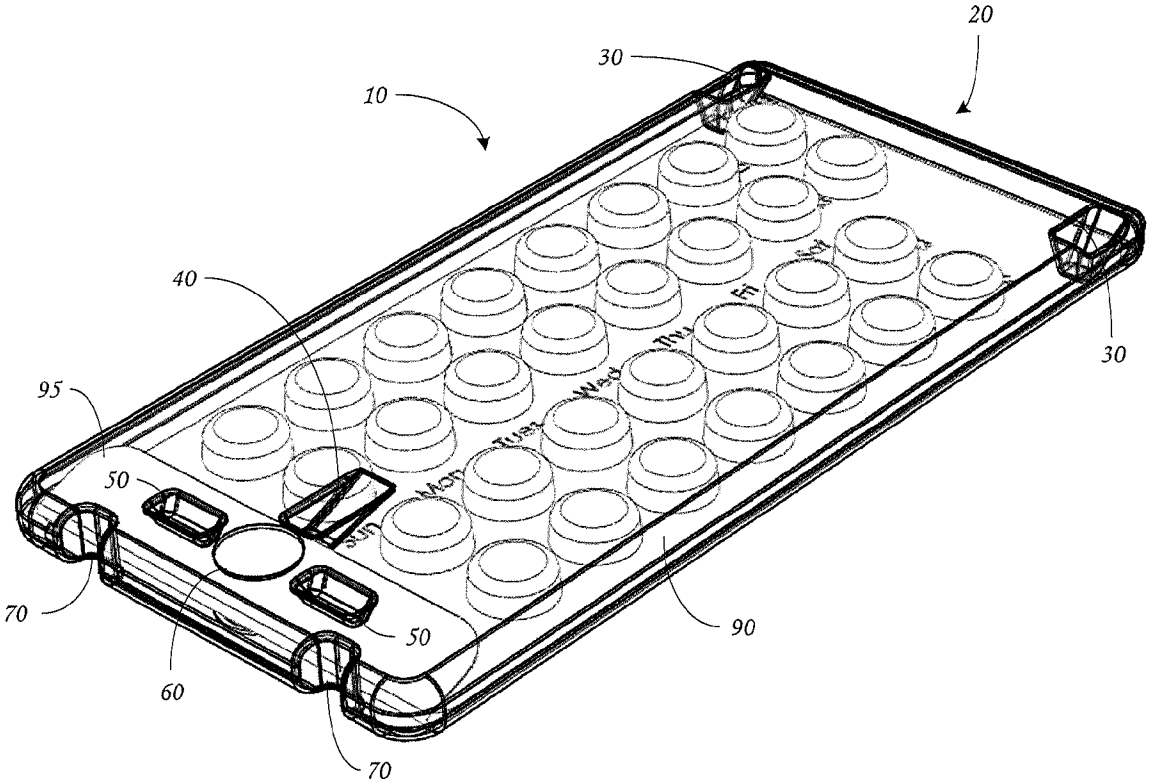
FIG. 5 is another perspective top view of a single piece container showing the insert card fully inserted into the container according to an embodiment of the invention.

FIG. 5 is another perspective top view of a single piece container 10 showing the insert card 90 fully inserted into the container 10 according to an embodiment of the invention. This illustration shows the crease separating the insert card 90 and insert card flap 95 abutting the insert card stops 70. The insert card flap 95 may further be positioned in place by locking guides 50 which prevent the insert card flap 95 from riding too high within the interior chamber of the container. The exposed edge of insert card flap 95 abuts the locking stop element 40 in the locked position to prevent the insert card 90 from being removed from the container 10. Removal of the insert card 90 necessitates manipulation of the locking/unlocking elements described more fully below.

Figure 6:
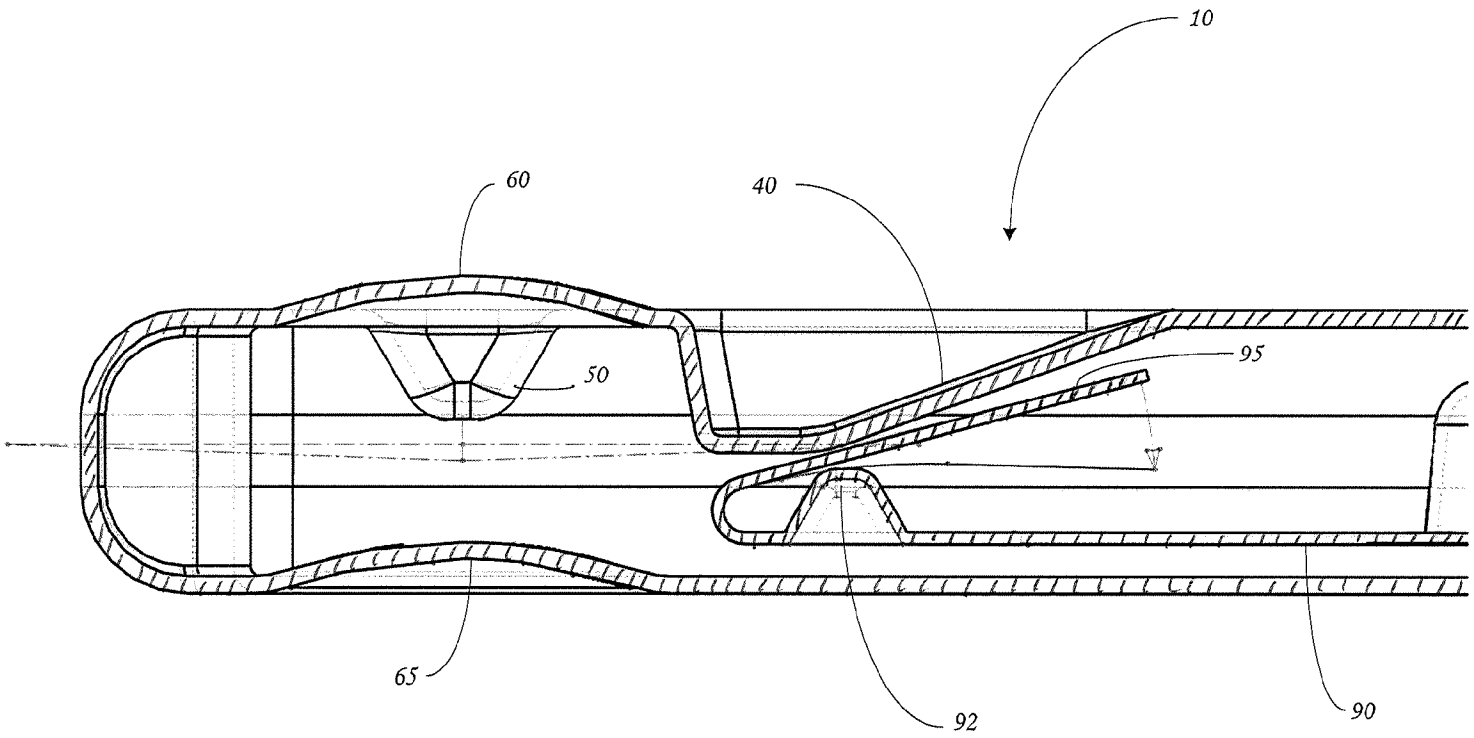
FIG. 6 is a cross-sectional view showing the interior of the single piece container with the insert card almost fully inserted therein.

FIG. 6 is a cross-sectional view showing the interior of the single piece container 10 with the insert card 90 almost fully inserted therein. This illustration is a snapshot of the insert card 90 just prior to being placed in the locked position. The leading edge of the insert card 90 includes the fold over portion that defines the insert card flap 95. As this section approaches the downward and rearward sloping locking stop element 40, the insert card flap 95 will deform as it slides by the lowest point of the locking stop element 40 creating a pivot point atop the insert card bump 92. There is sufficient clearance between the insert card bump 92 and the lowest point of the locking stop element 40 to allow the rest of the insert card flap 95 to pass through.

Figure 7:
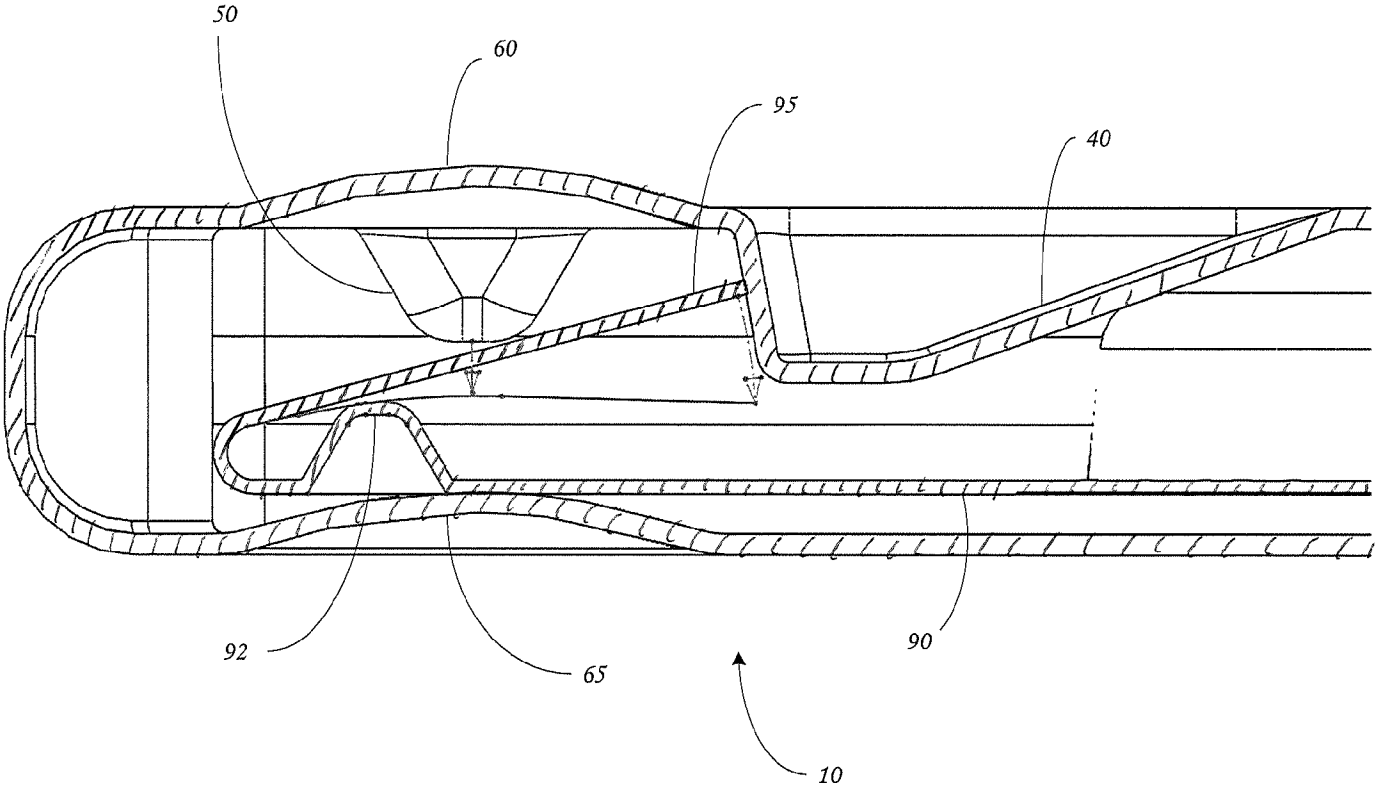
FIG. 7 is a cross-sectional view showing the interior of the single piece container with the insert card fully inserted therein.

FIG. 7 is a cross-sectional view showing the interior of the single piece container 10 with the insert card 90 fully inserted therein. This illustration shows the insert card 90 in the locked position. The leading edge of the insert card 90 abuts the insert card stops 70 preventing the insert card 90 from further advancing within the interior chamber of the container 10. The insert card flap 95 has rebounded from the deflected position that was required to clear the lowest point of the locking stop element 40. The insert card flap 95 is now held in place with the assistance of the indent support platform 65, the locking guides 50 and the rear wall of the locking stop element 40. The insert card 90 is partially seated upon indent support platform 65 and cannot be removed from the container 10 without manipulation of the locking release button 60.

To unlock the insert card 90 so that it can be withdrawn from the container 10, a downward force is applied to locking release button 60. This action will cause the inward deflection of locking guides 50. When a sufficient force has been applied, the insert card flap 95 will have been deflected such that its exposed edge will be below the level of the lowest point of the locking stop element 40. At this point, the user can grip the opposite edge of the insert card 90 that is accessible via opening 20 and pull the insert card out of the container 10. Since the insert card flap 95 is below the lowest point of the locking stop element 40 it will slide past the locking stop element 40 and can continue to be withdrawn until it encounters the retaining elements 30. It is to be understood that other methods/means of locking and releasing the inner card or tray may be used. Manufacturing preferences may dictate the best way to form the locking and releasing elements on the container and on the insert card to create a locking and releasing interaction between the two.

Locking release button 60 may be curved. In such a case, it may be beneficial to have nesting area 65 formed in a complementary arch such that multiple packages may be stacked upon one another. It is also to be understood that locking release button 60 may lay flat along the top surface of container 10. In such a package, nesting area 65 may also be flat. The interaction between insert card bump 92 and locking guide 50 when locking release button 60 is pressed by the user allows inset card flap 95 to arch such that the front end toward the open end of container 10 of insert card flap 95 bends more quickly than the back end. This allows the front end of insert card flap 95 to clear the locking stop element 40 more quickly and allows for easier access to the insert card. The insert card flap 95 may contact the locking stop element 40 at about a 90 degree angle when the insert card is in the locked position. The front portion (towards the opening of container 10) of locking stop element 40 may be angled on the side towards the open end of container 10 such that the insert card may be slid into the package with little to no interference. The end portion of locking stop element 40 may be angled such that it forms a 90 degree angle or close to a 90 degree angle with the insert card flap 95. It is understood that locking stop element 40 may have one or more additional segments.

Figure 8:
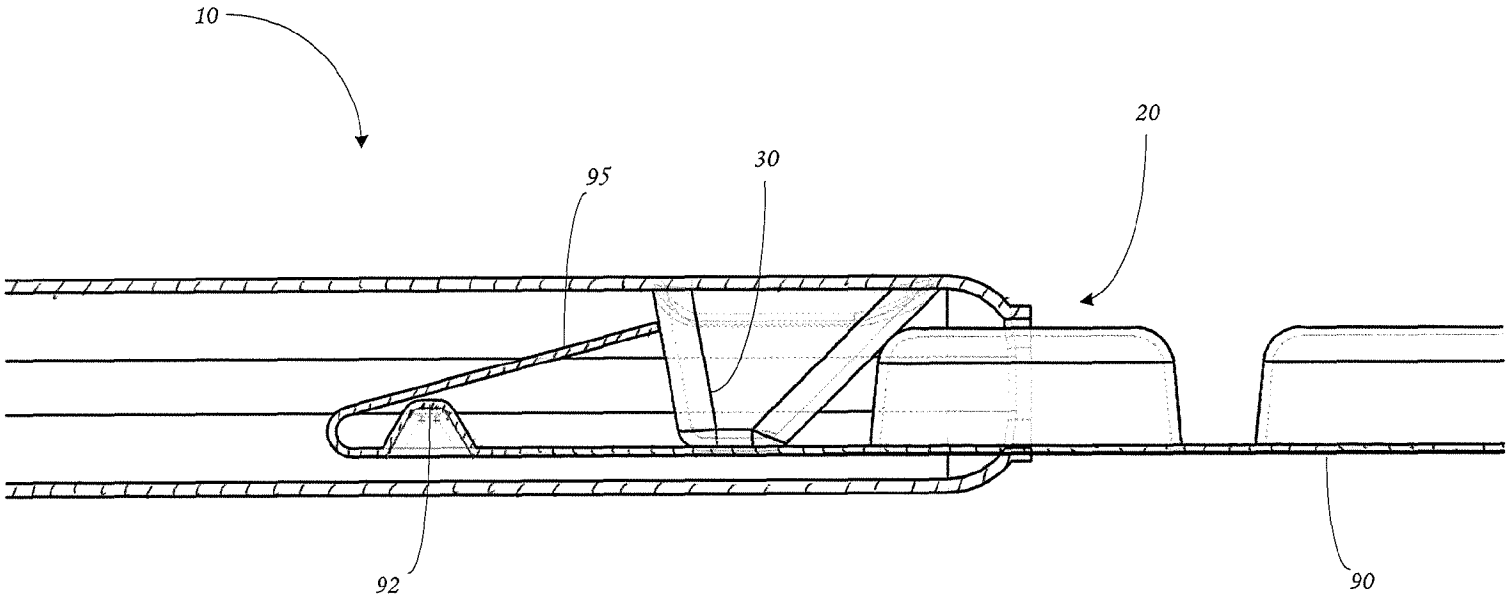
FIG. 8 is a cross-sectional view showing the interior of the single piece container with the insert card almost fully retracted therefrom.
Figure 9:
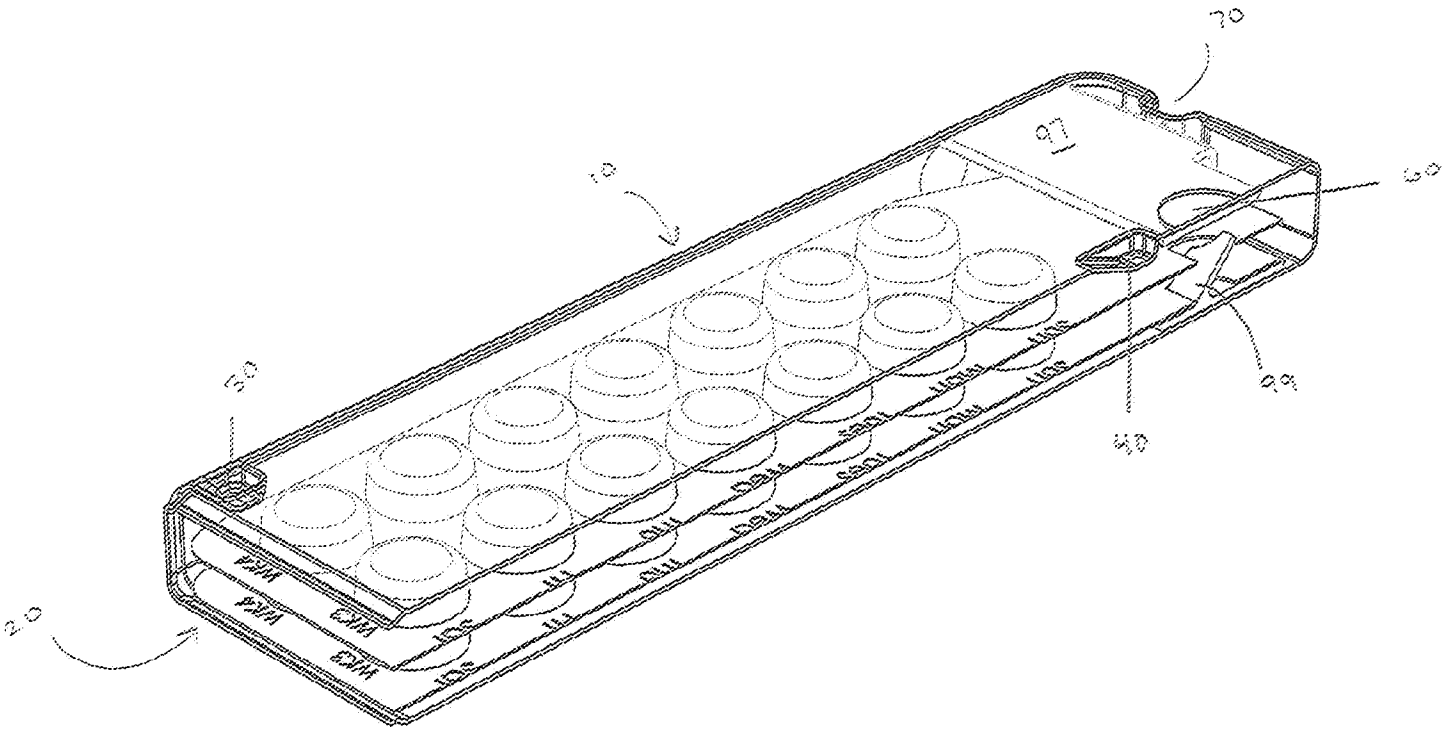
FIG. 9 is a perspective view partially cutaway, showing the interior of a single piece container holding a plurality of insert cards.
Figure 10:
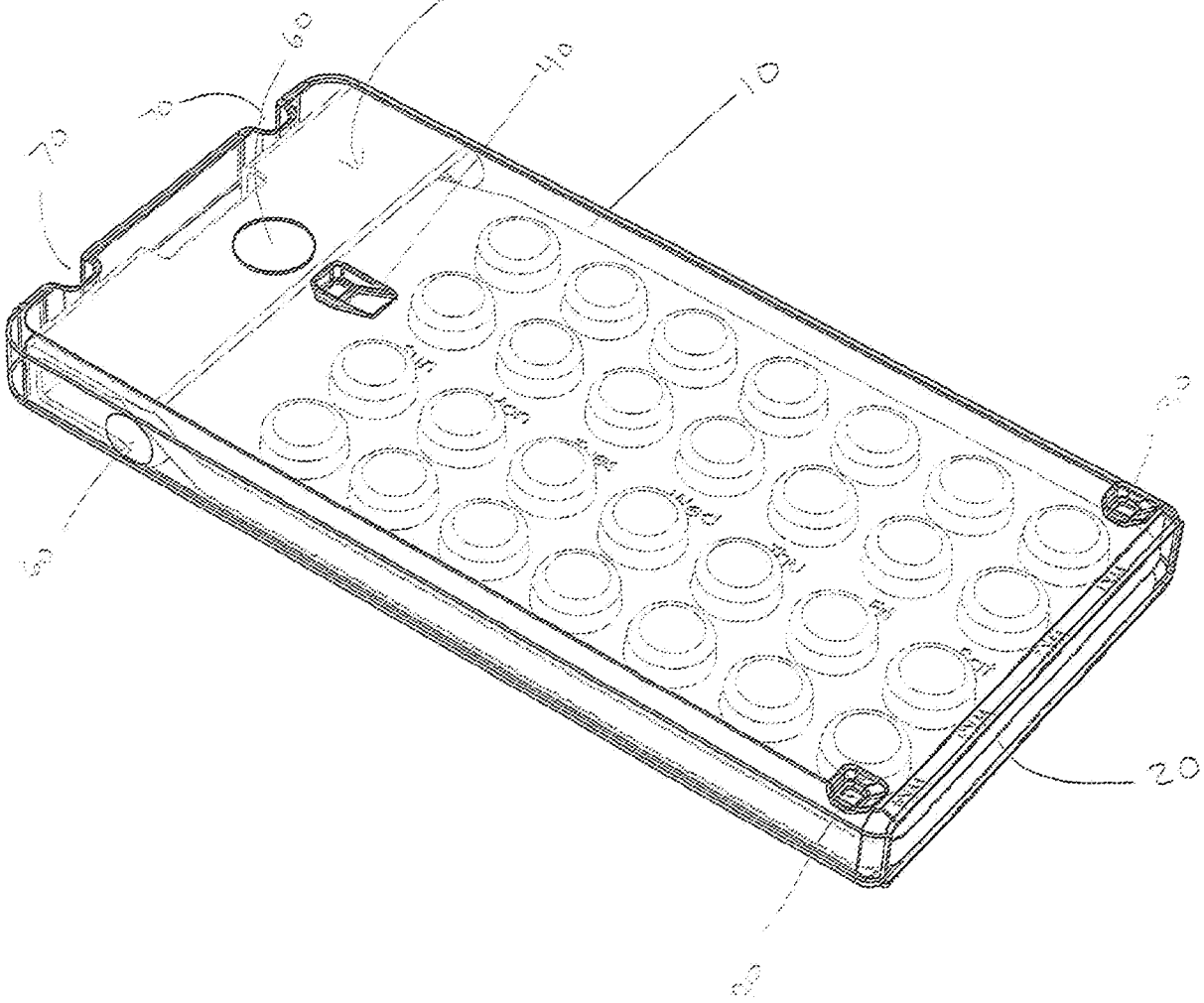
FIG. 10 is a perspective top view showing the container with multiple insert cards and using a traveler.
Figure 11:
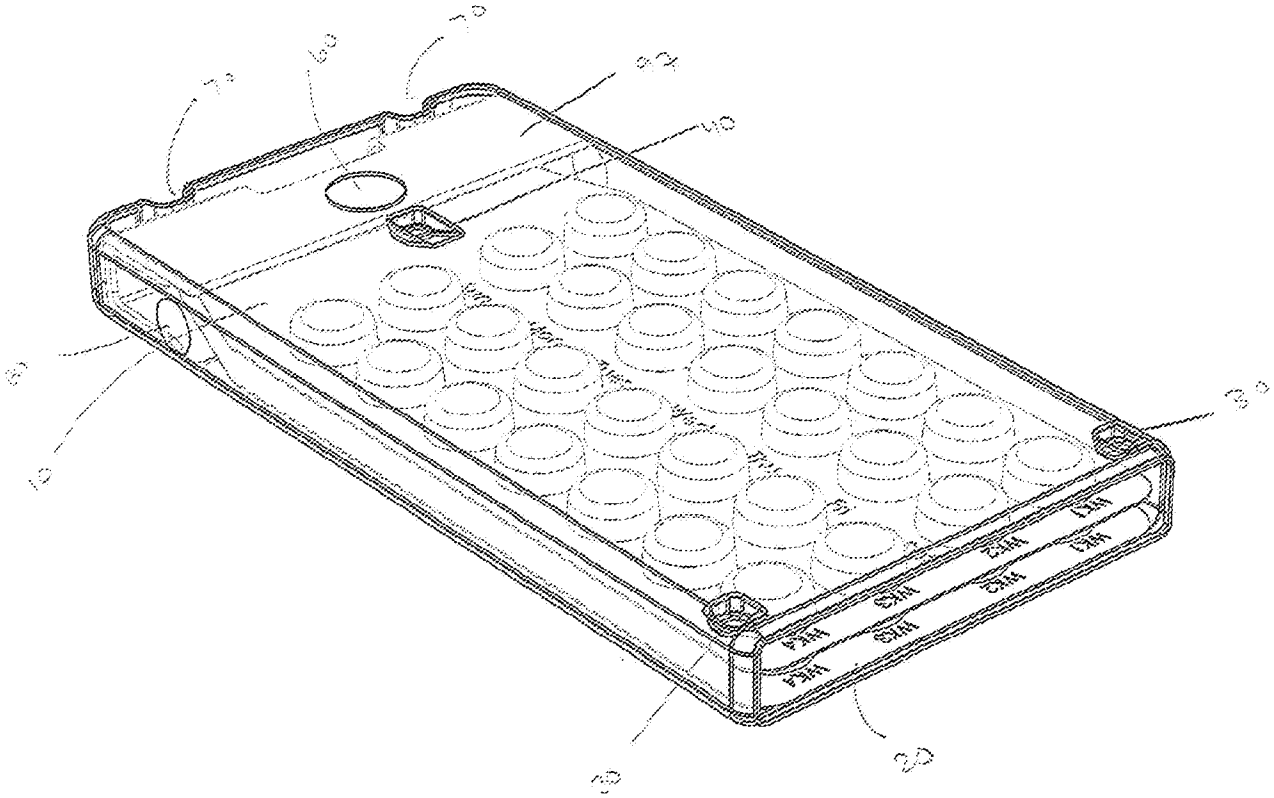
FIG. 11 is a perspective front view showing the container with multiple insert cards and using a traveler.
Figure 12:
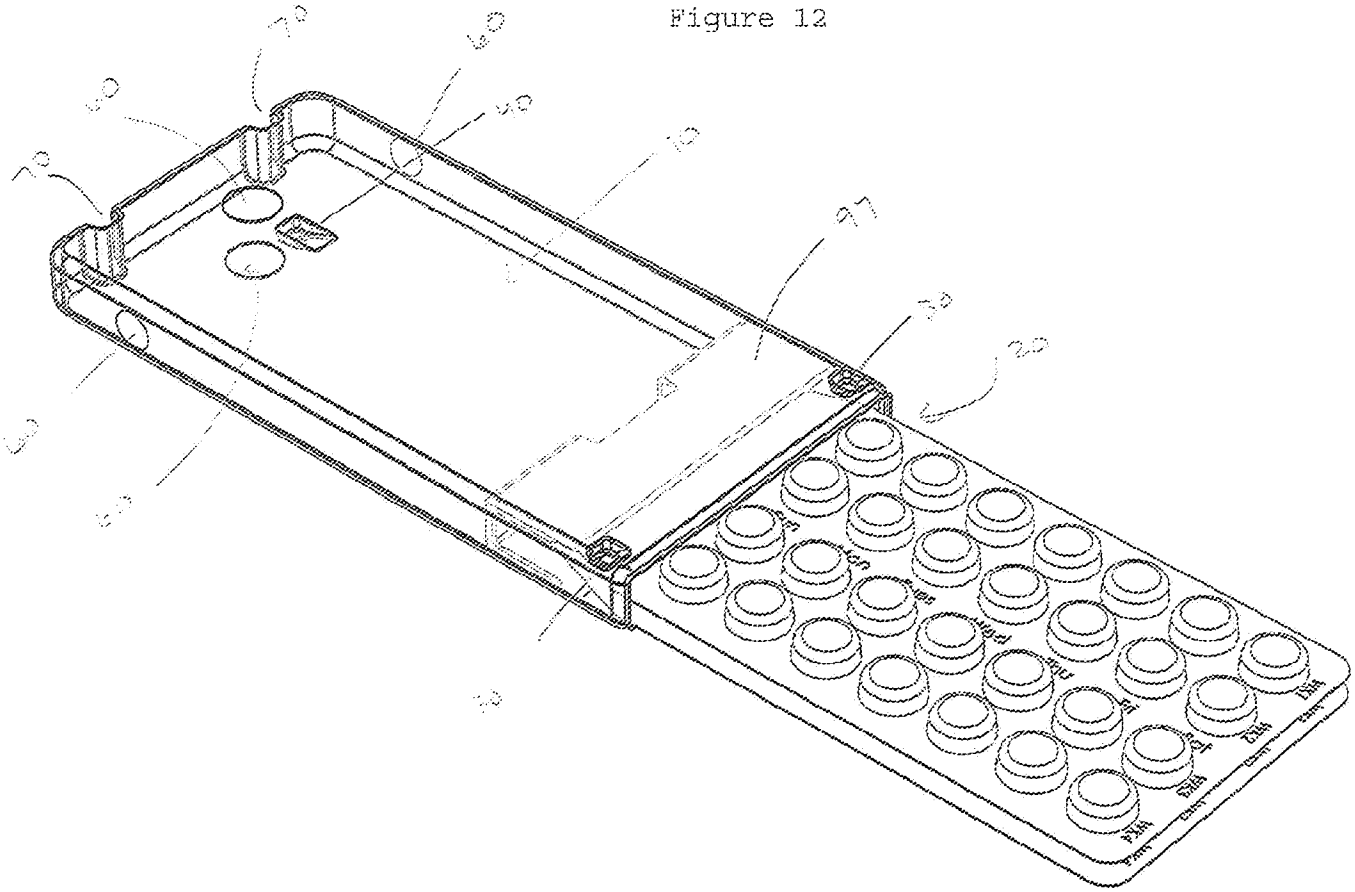
FIG. 12 is a perspective top view showing the container with multiple insert cards and using a traveler in its fully opened state.
Figure 13:
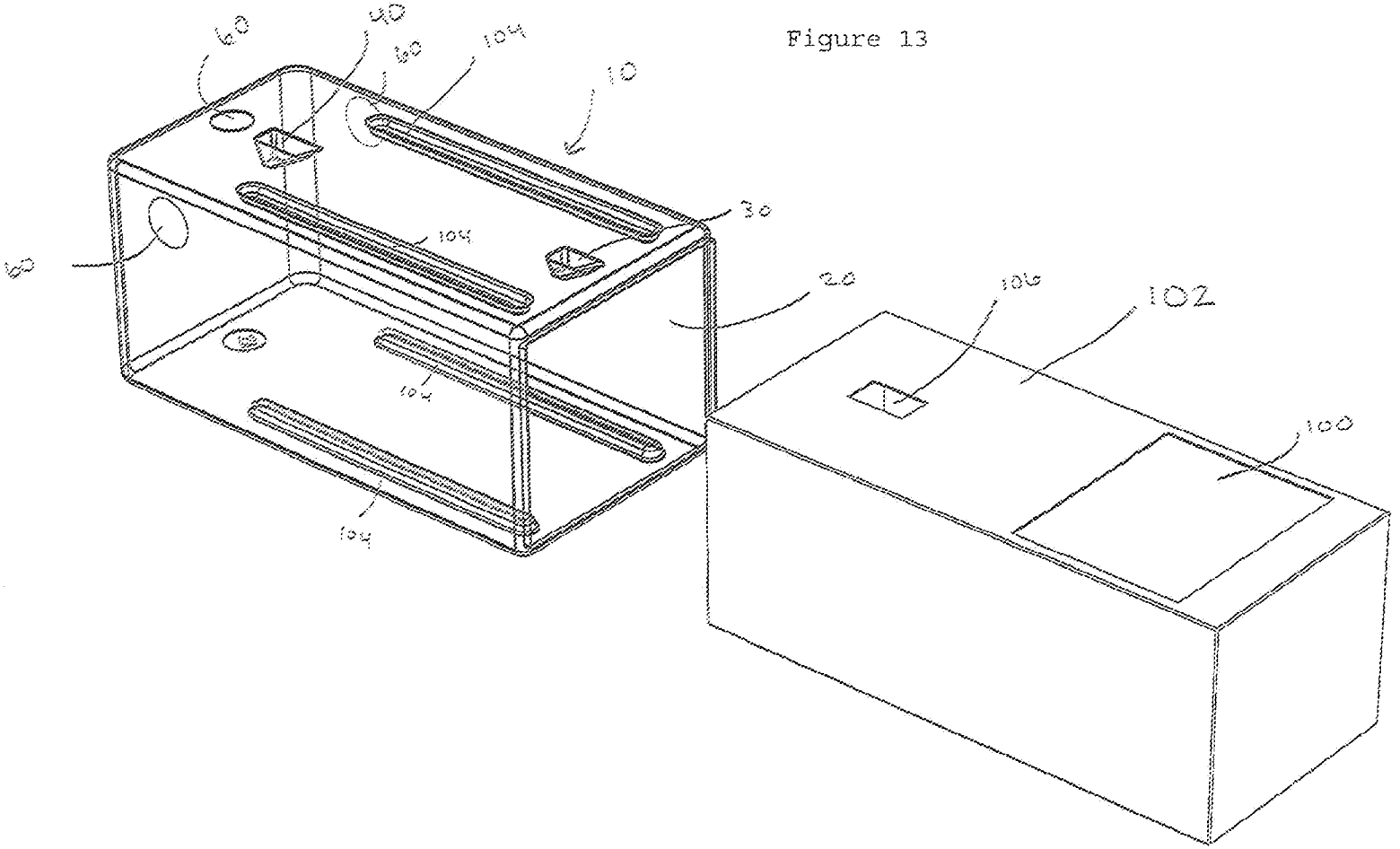
FIG. 13 is a perspective side view of an alternate embodiment using a slidable tray in place of an insert card.
Figure 14:
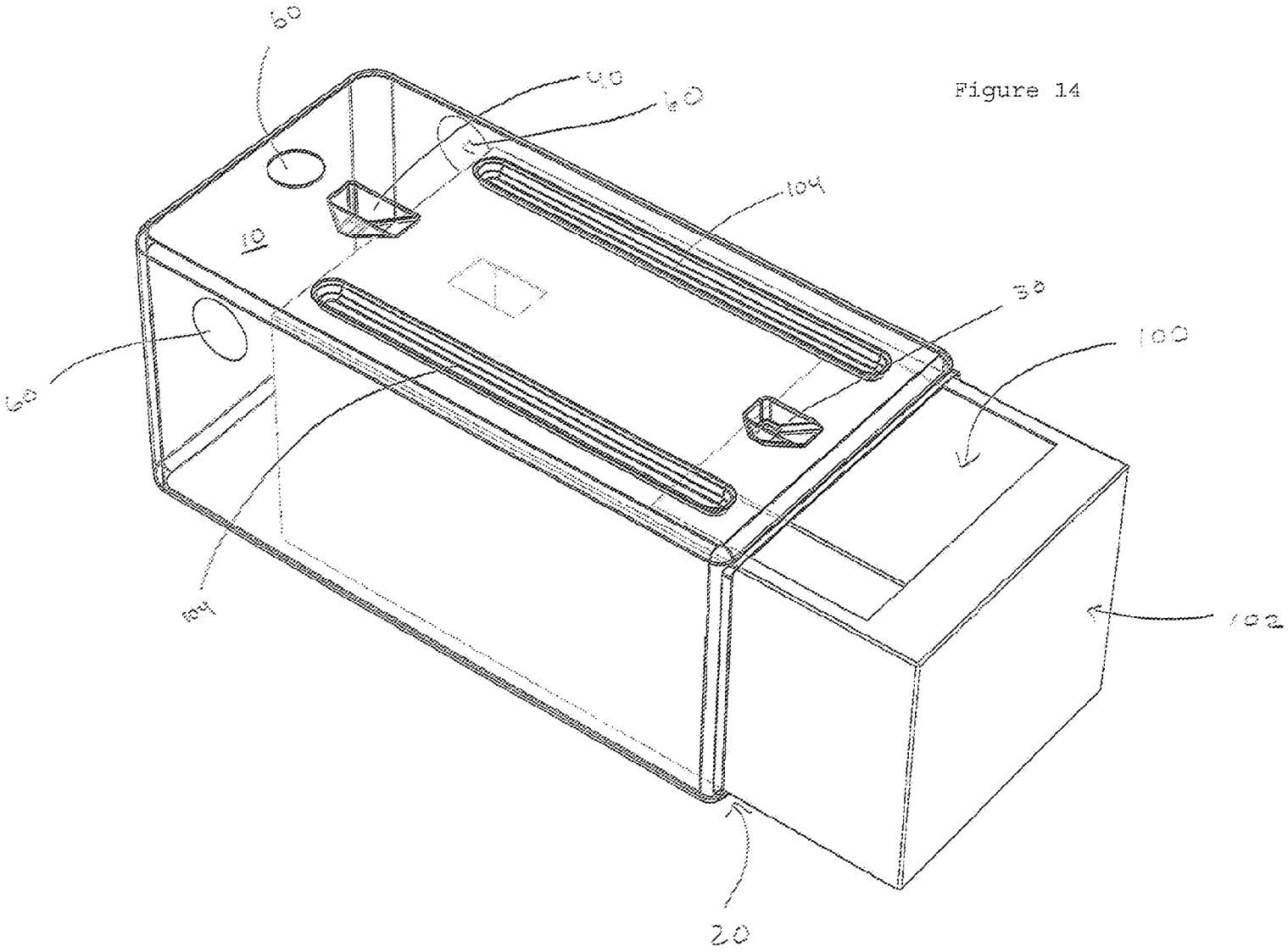
FIG. 14 is a perspective side view of the container of FIG. 13, showing a partially opened container using a slidable tray in place of an insert card.
Figure 15:
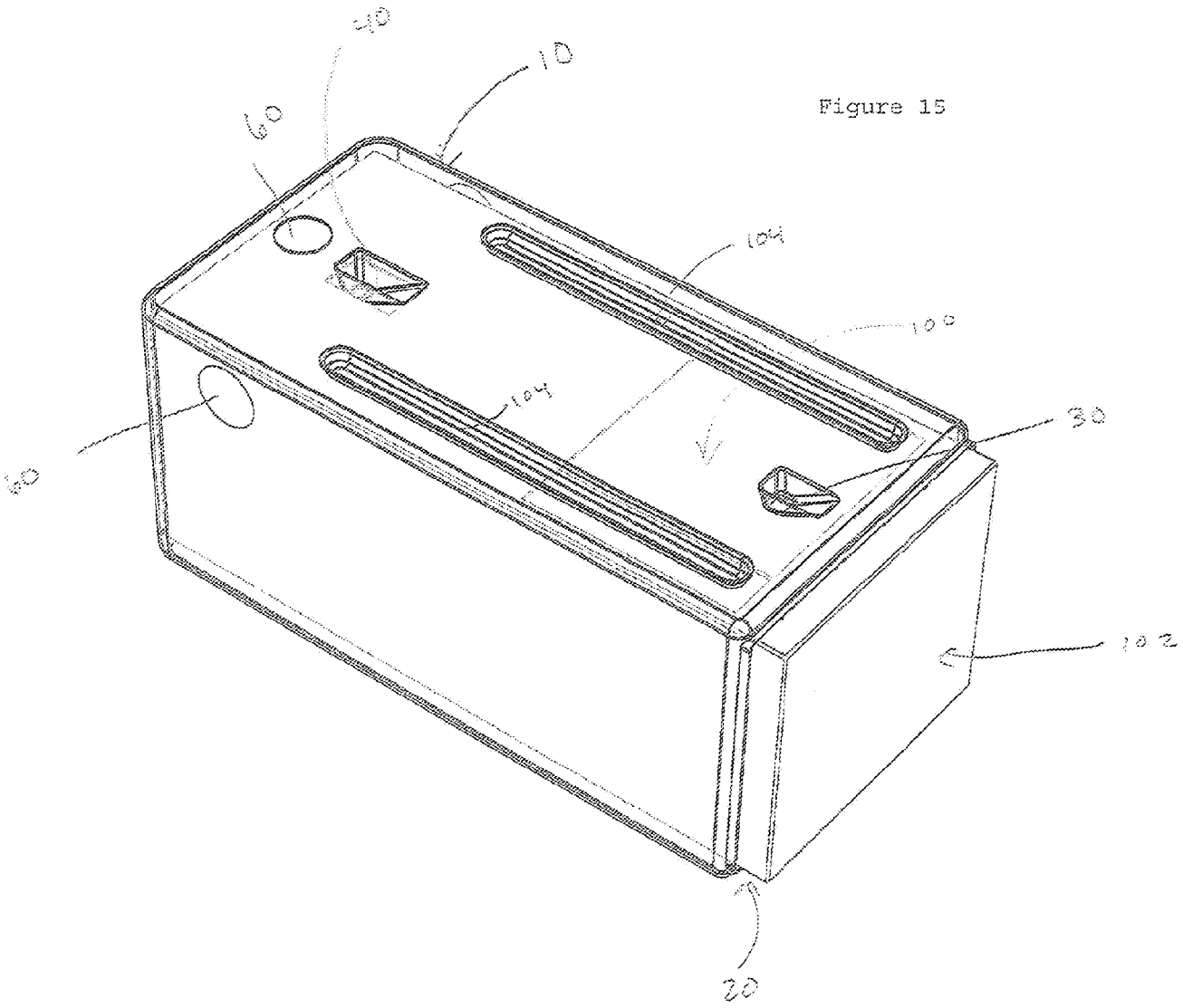
FIG. 15 is a perspective side view of the container of FIG. 13, showing an almost closed condition of that container.
Figure 16:
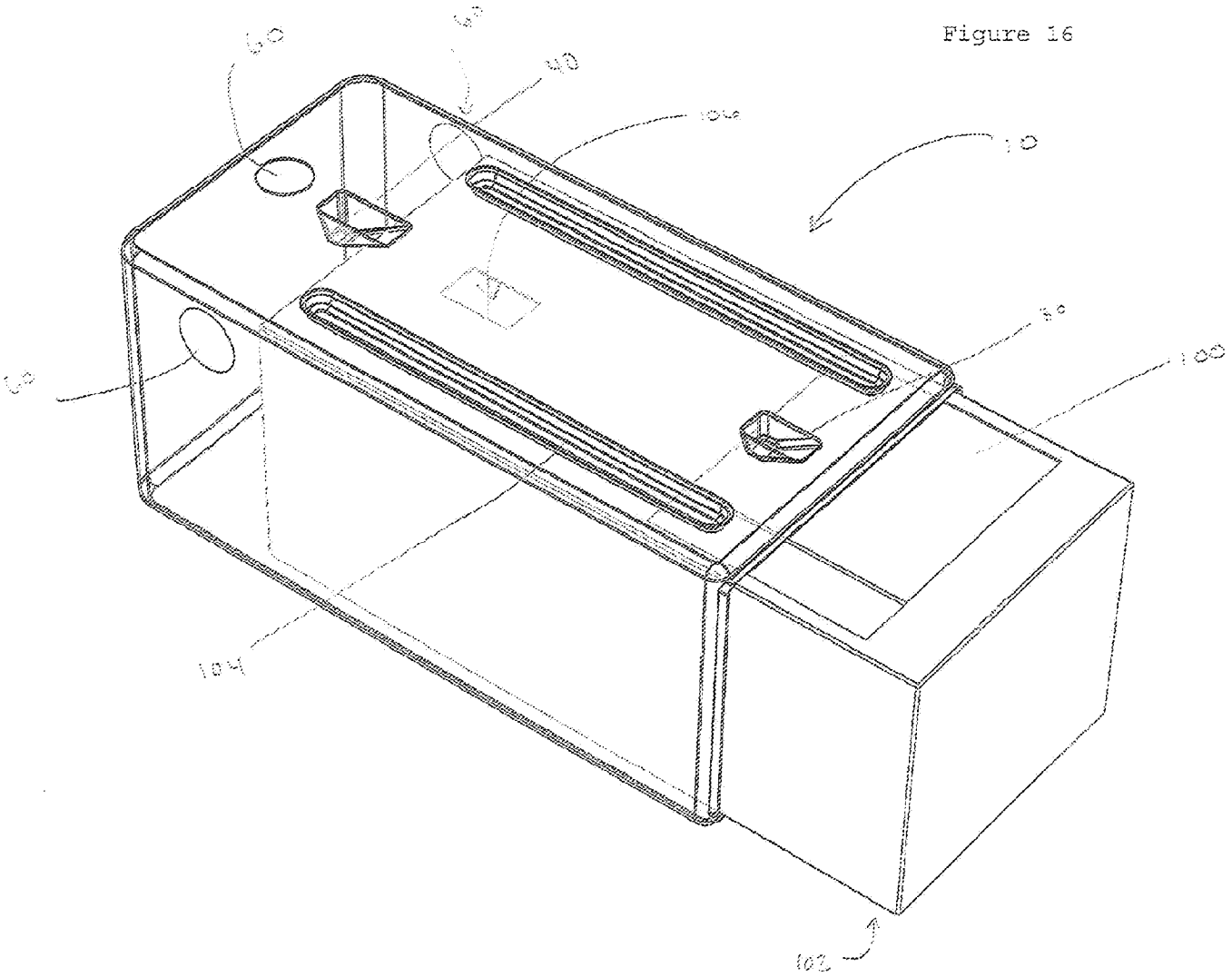
FIG. 16 is a perspective view similar to FIG. 14.

FIG. 8 is a cross-sectional view showing the interior of the single piece container 10 with the insert card 90 almost fully retracted therefrom. In this illustration the insert card flap 95 encounters the retaining elements 30 that are positioned on either side of the opening 20 of container 10. The retaining elements 30 are similar to the locking stop element 40 in that they slope inward and downward from the interior of the top surface of the container and have a generally vertical face that returns to the interior top surface of the container 10. There is no locking release button, however, that could assist in deflecting the insert card flap below the lowest point of the retaining elements 30. Thus, the insert card 90 is held within the container 10 such that it can not be fully extracted.

In addition, it should be understood that multiple blister cards may be contained within container 10. FIGS. 9-12 show examples of a multi-blister pack. It uses a plastic insert 97 able to hold multiple blister cards as disclosed in U.S. Pat. Application Nos. 61/120,929 and 61/287,960 incorporated by reference herein. A traveler mechanism 97 is coupled with the plurality of primary packages and adapted to fit within container 10 in a lockable slidable fashion. The traveler mechanism 97 securely retains the plurality of primary packages. The container 10 may further include a thumb/finger indent at the open end front edge to assist a person when grasping a primary package contained within container 10. The traveler mechanism 97 is comprised of top and bottom portions that may be snap fit (or glued or otherwise adhered) together such that when fit together, the traveler mechanism may be seated within the interior chamber of the container 10 in a lockable and slidable fashion. The traveler may be a single piece structure formed from a formable material, plastic fiber, metal, clay and or paperboard. It may be machine made or molded by injection, blow molded or formed by other methods. The traveler mechanism may have a dagger 99 to hold a plurality of insert cards. The traveler mechanism 97 further comprises one or more flexible release tab(s) 60 that includes a release tab stop 40 on at least one of the top and bottom portions of the container 10 such that the release tab stop 40 will abut the elongated tapered stop in a locked position that prevents the traveler mechanism 97 from sliding outward. It is to be understood that this locking element 40 may extend outside of the package. The traveler mechanism 97 further comprises a flat surface adapted to engage the at least one traveler stop 30 to prevent the traveler mechanism 97 from being completely withdrawn from within the interior chamber of the container 10 and at least one post adapted to fit within the at least one aperture of the plurality of primary packages. Directional channels may be formed along the side edges of the interior of container 10 such that the side edges of the traveler may glide along these level changed areas. It is to be understood the seamless structure of the single piece contained may not require the use of these directional channels. One or more release button(s) 60 may be on the top, bottom or sides of the container 10. It is to be understood that the location of the release button 60 will be determined based on manufacturing preferences and the locking mechanism 40 chosen. For some formats a side squeeze opening feature will be appropriate and for others a top and or bottom opening feature would be more effective.

FIGS. 13-16 disclose a container 10 holding a slidable tray 102. The slidable 102 tray may have one or more openings 100 to allow the user to access a product. The product may be a loose fill product such as mints, gum, cigarettes, pills, bandaids, syringes, topical treatments or any other such products. The inside of tray may be lined with water resistant material or other such barrier materials. The inner tray 102 may be a blow molded structure, plastic, paperboard or other types of material. The product may be in the form of pouches of medication as well such as travel packs. One or more channels 104 may be added to container 10 to keep the inner tray 102 from moving while it is in the closed position. It is to be understood that these channels 104 may improve the ability of locking element 40 to interact with opening 106. The leading edge of opening 106 may maintain an almost 90 degree angle with locking element 40. It is to be understood that opening 100 may be covered by a re-sealable material such that it rolls back as the package is removed and re-seals as the package is returned to the locking position. Such material may have barrier properties. It is to be understood that opening 100 may be covered by paperboard with perforations around the opening area such that the user may remove the paperboard of other such material to access the product. A lip may be formed around the opening 20 of the container 10 such that opening 20 may be smaller than the interior cavity of container 10. This feature may assist with the effectiveness of the locking and retention features as well as child resistance.

Figure 17:
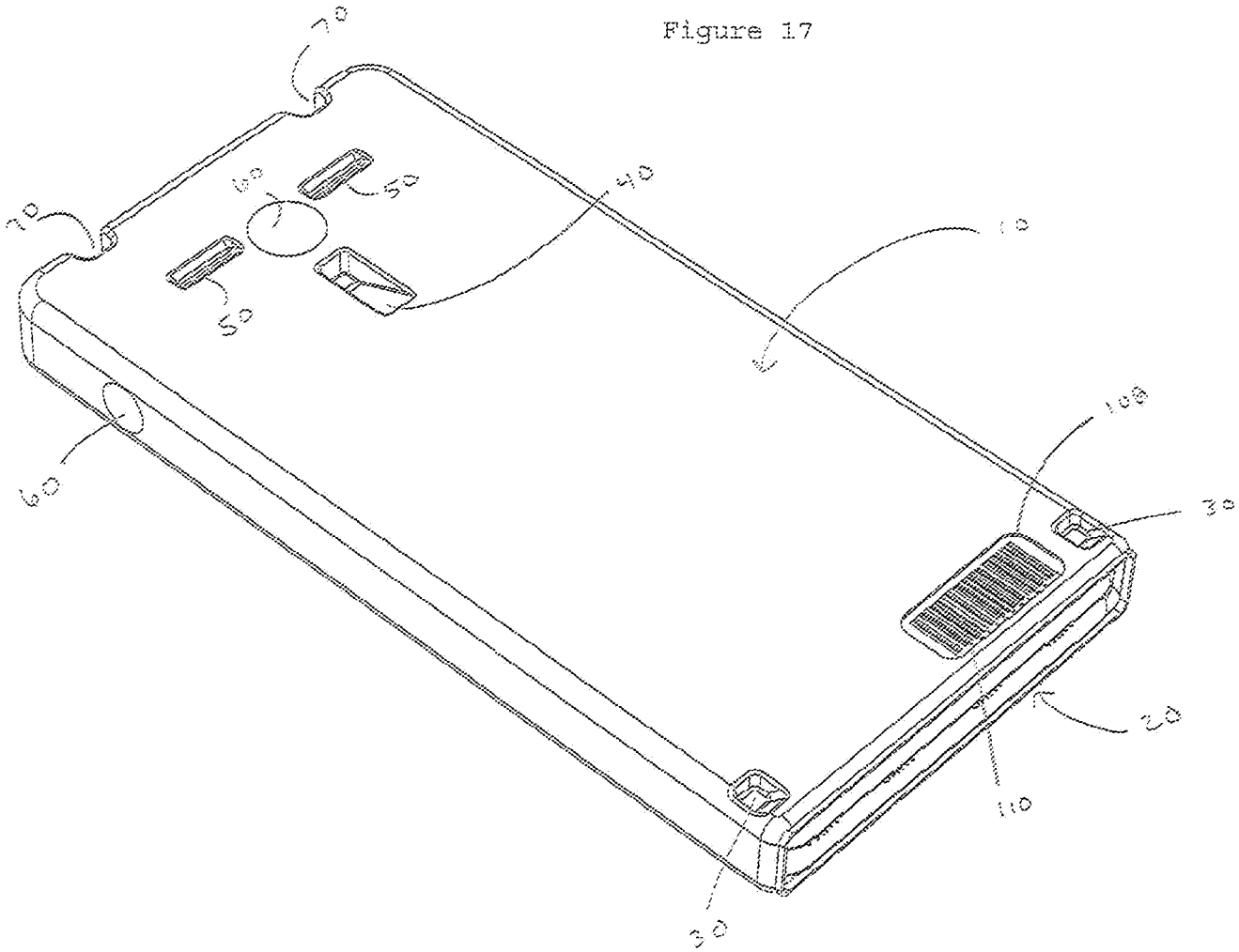
FIG. 17 is a perspective view of a container having a cut out area around the barcode.
Figure 18:
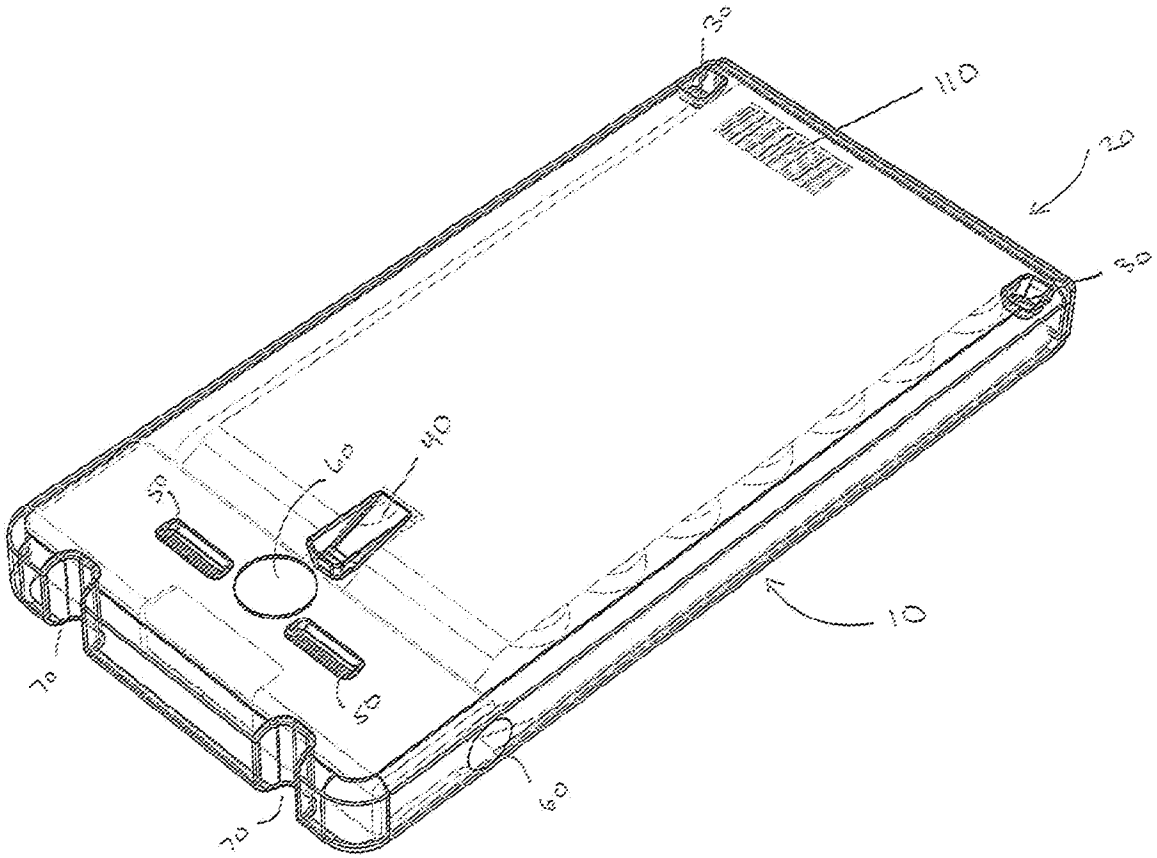
FIG. 18 is a perspective view of a container showing the bar code through the container and having no cut-out.
Figure 19:
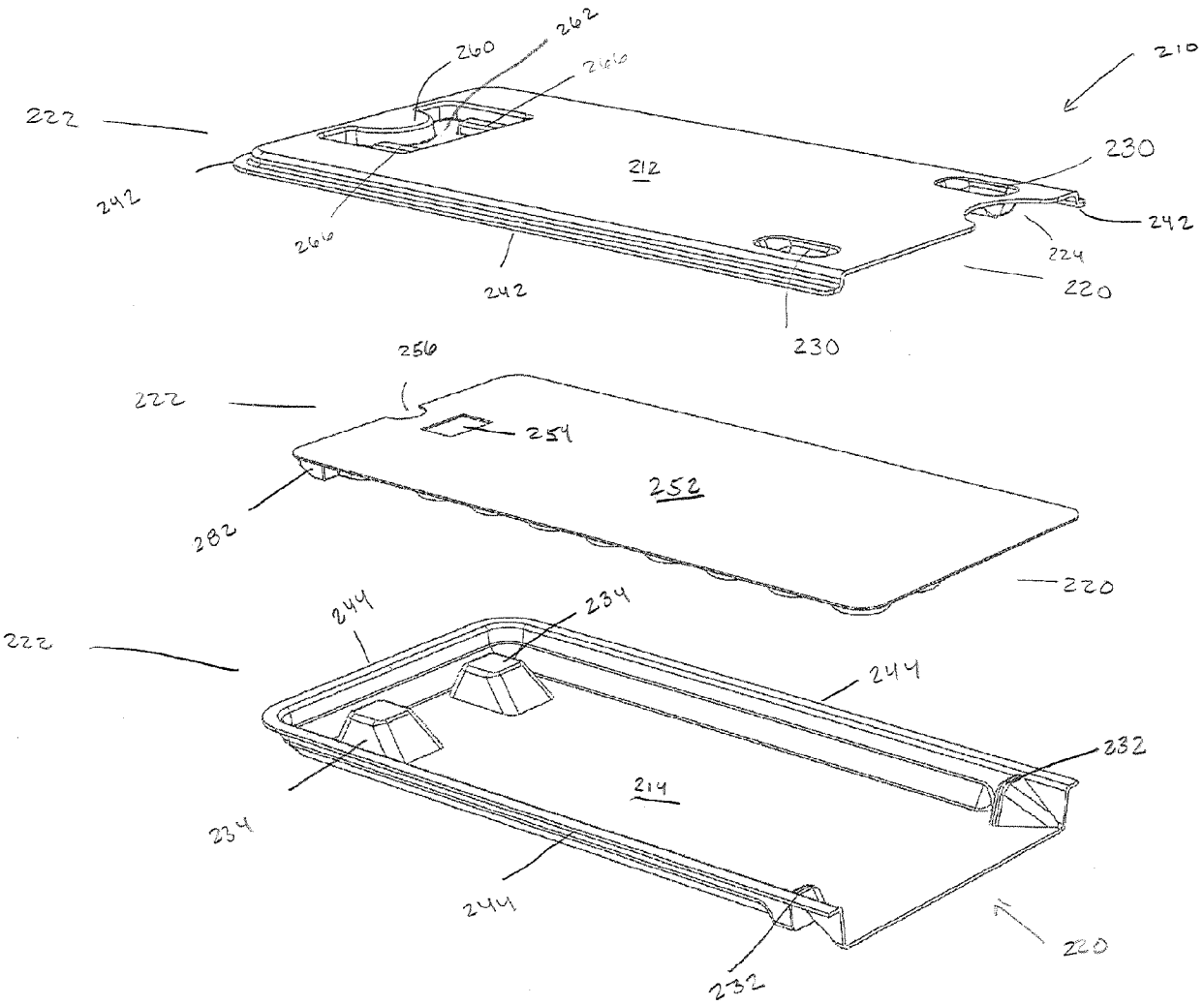
FIG. 19 is an exploded perspective top view of a two-piece container with an insert card.
Figure 20:
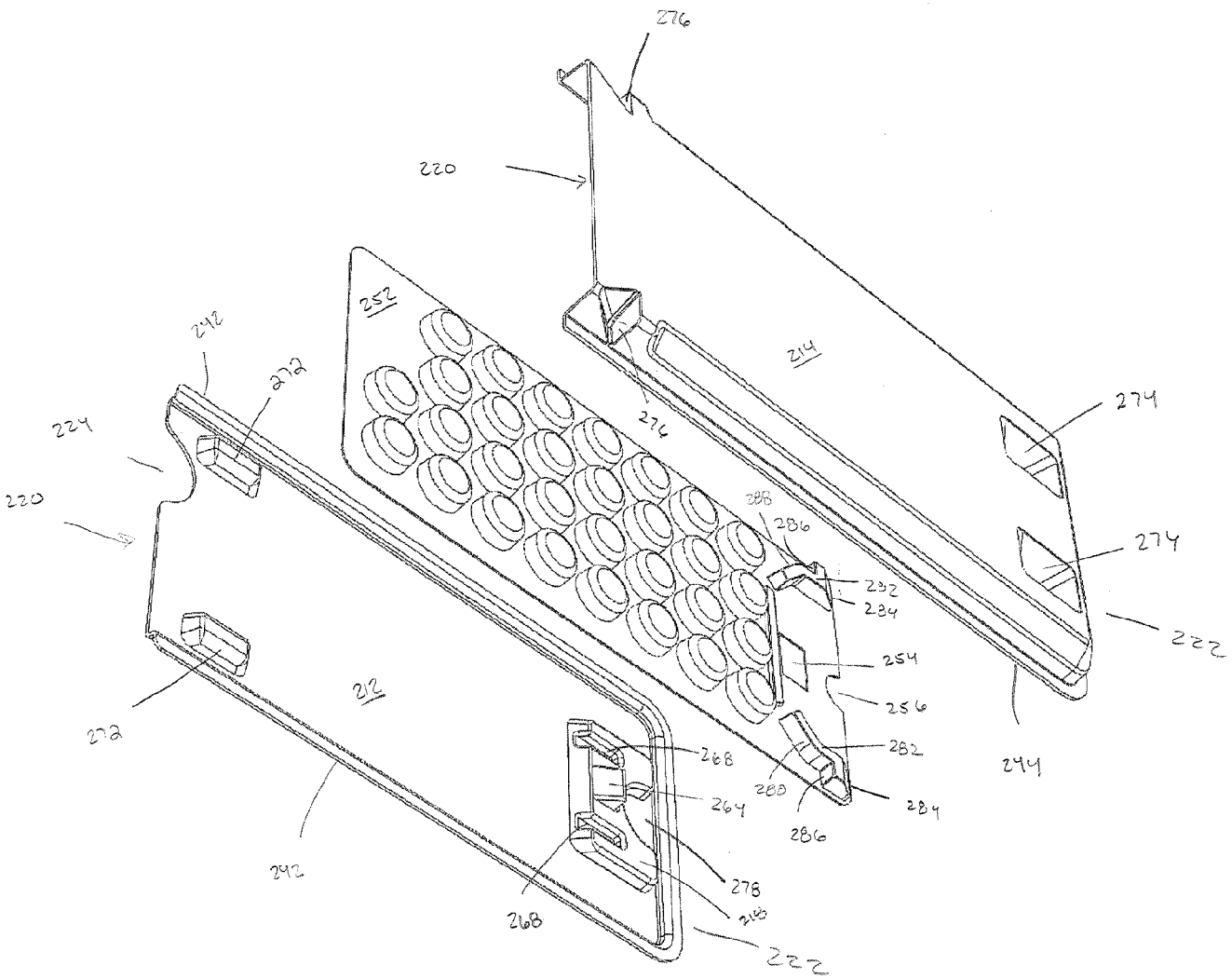
FIG. 20 is an exploded perspective bottom view of the two-piece container of FIG. 19.
Figure 21:
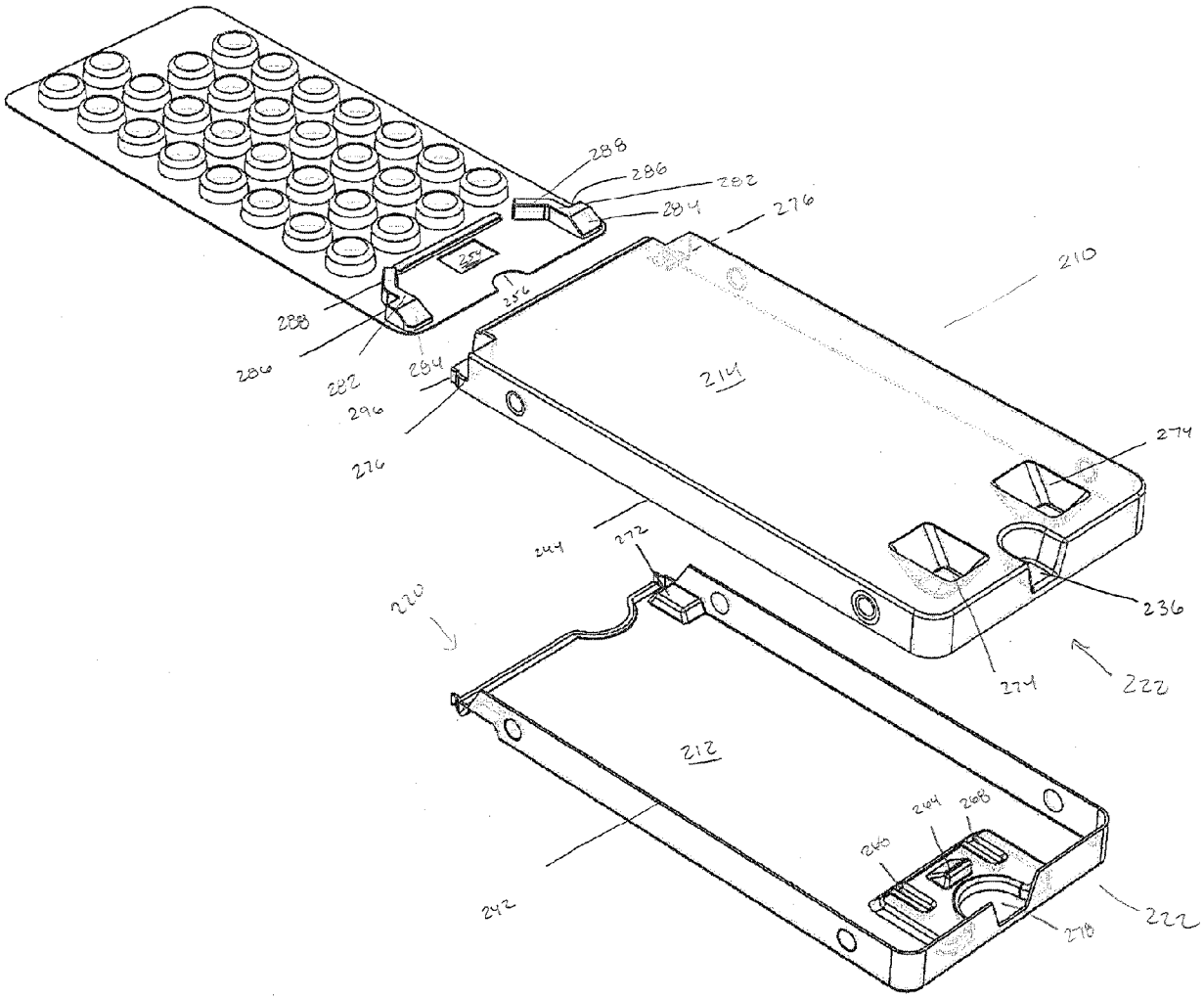
FIG. 21 is an alternate exploded perspective bottom view of the two-piece container of FIG. 19.
Figure 22:
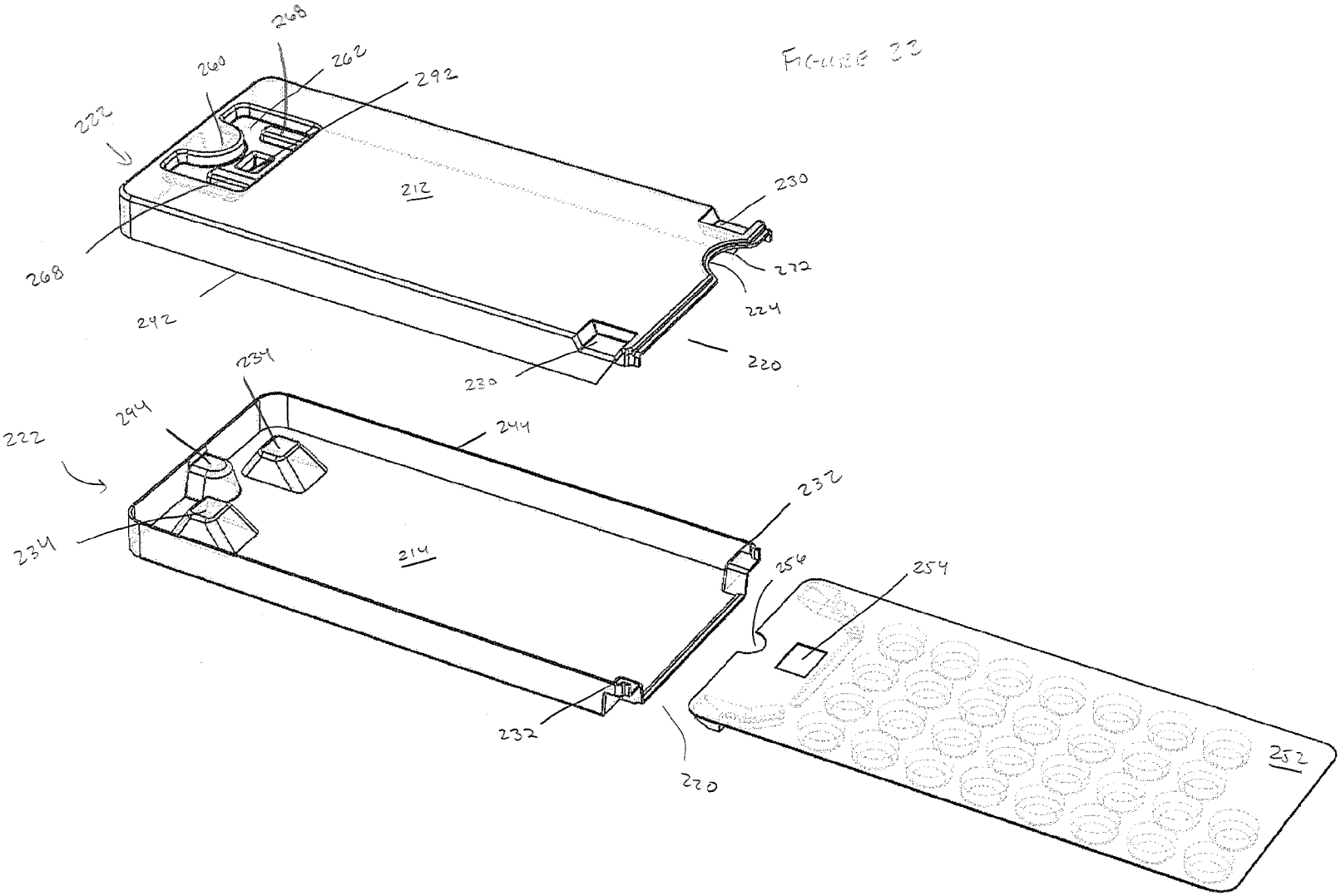
FIG. 22 is an alternate exploded perspective top view of the two-piece container of FIG. 19.
Figure 23:
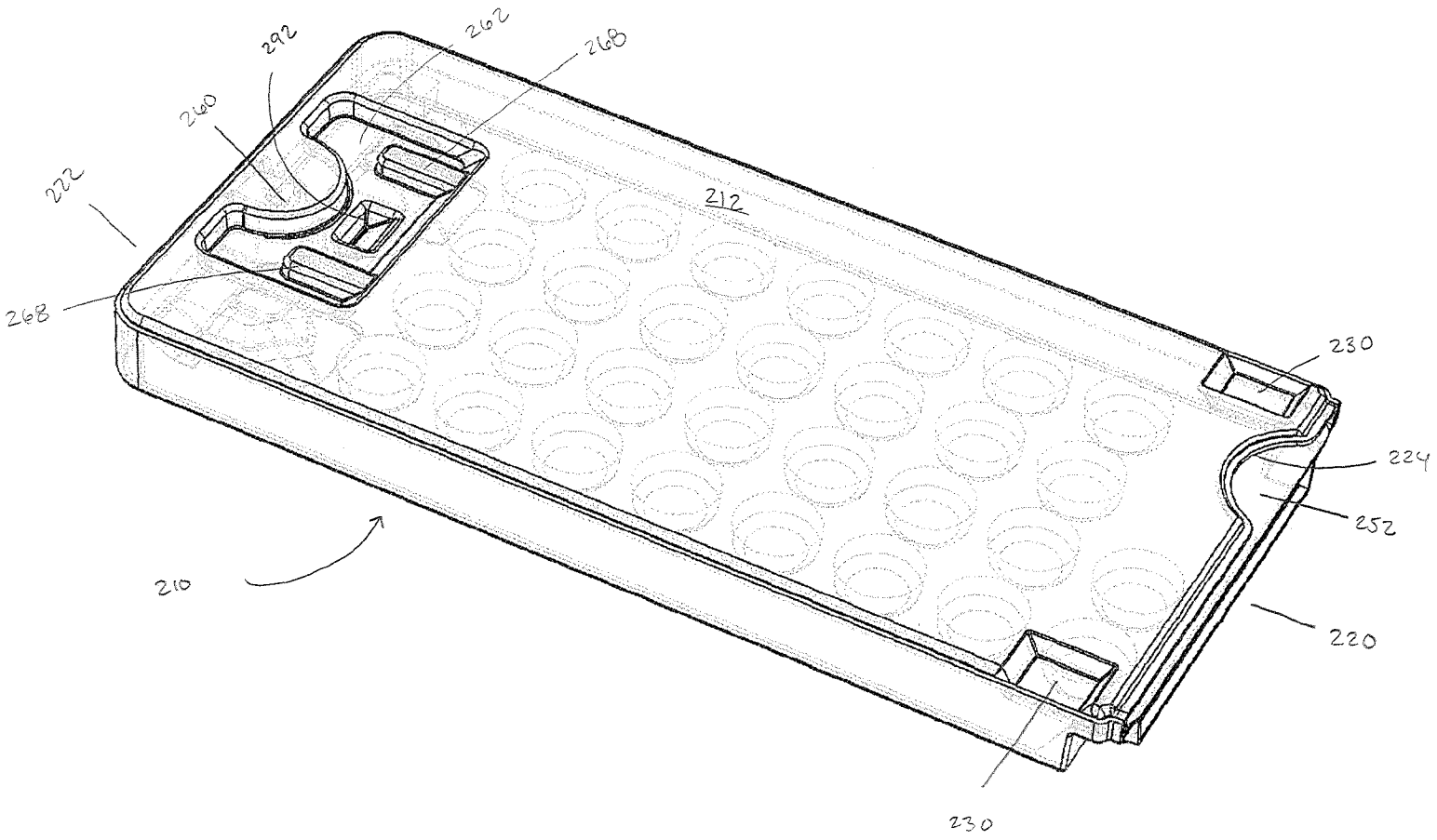
FIG. 23 is a perspective top view of the two-piece container of FIG. 19 in an assembled condition with the insert card in a closed or fully inserted position.
Figure 24:
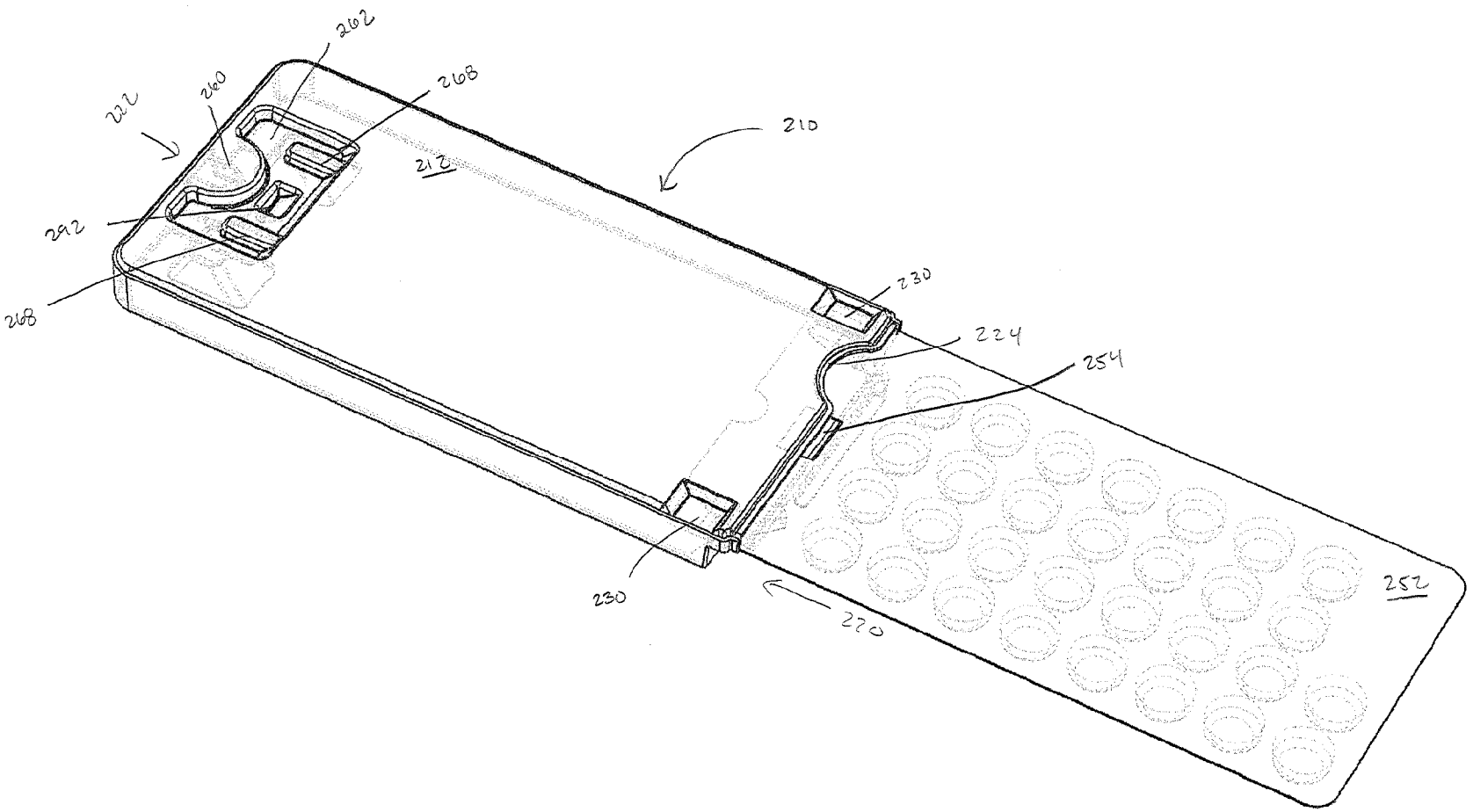
FIG. 24 is a perspective top view of the assembled two-piece container of FIG. 23 with the insert card in an open or withdrawn position.
Figure 25:
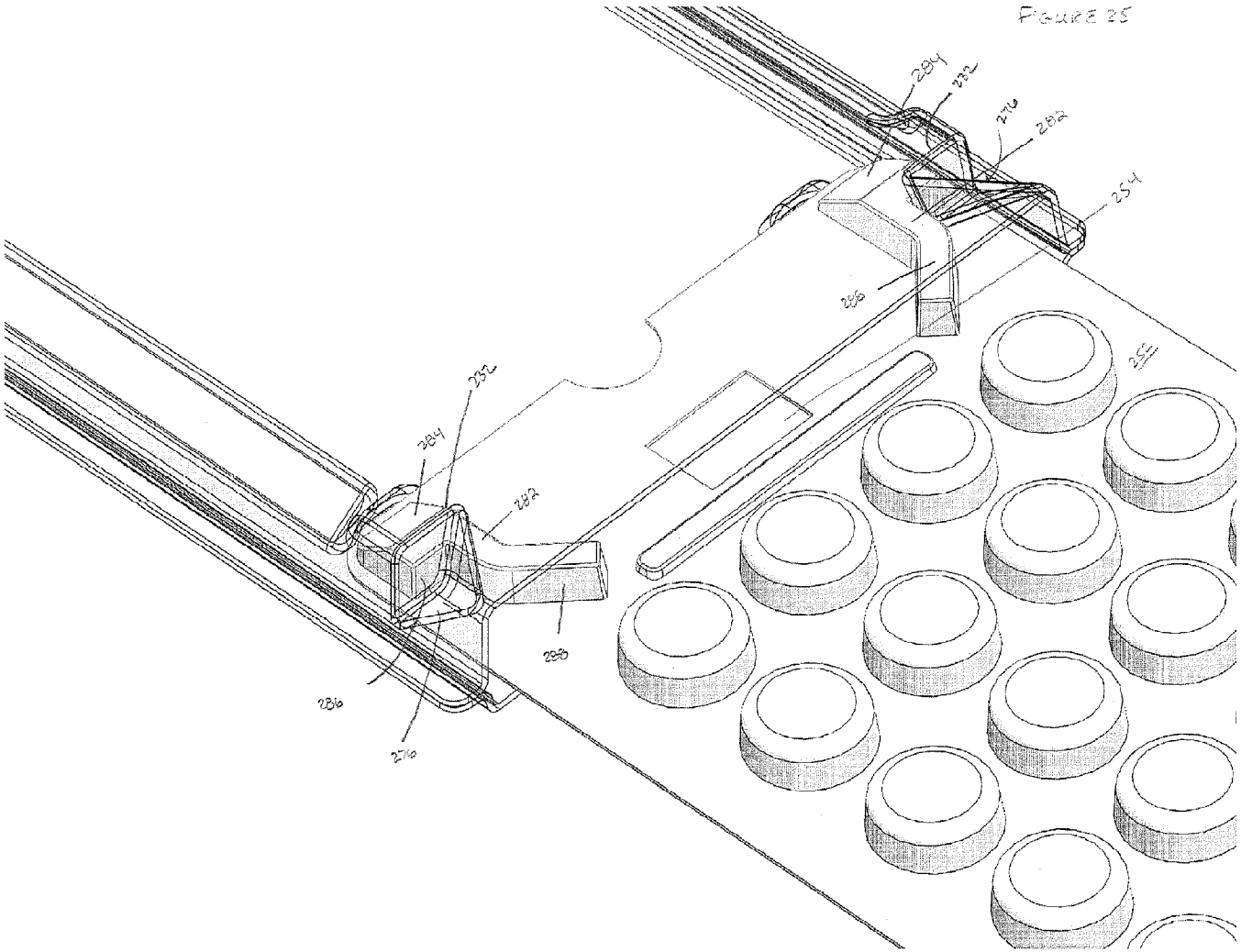
FIG. 25 is a close-up bottom perspective view of the assembled container of FIG. 24, showing retention features on the insert card and the container.

FIGS. 17-18 illustrate a container 10 with a product barcode 110 on the insert cards. It is to be understood that an opening may be formed in the package such that barcode 110 may be scannable. T is also to be understood that barcode 110 may be scannable through container 10 such that no opening in the package is needed.

It is to be understood that in any of these embodiments locking element 40 and insert card flap 95 may interact such that a portion of the interaction occurs outside of container 10. For example, locking element 40 may be an opening that insert card flap 95 may extend through. To open the user may need to push insert card flap 95 into the container such that it slides under locking element 40.

Figure 26:
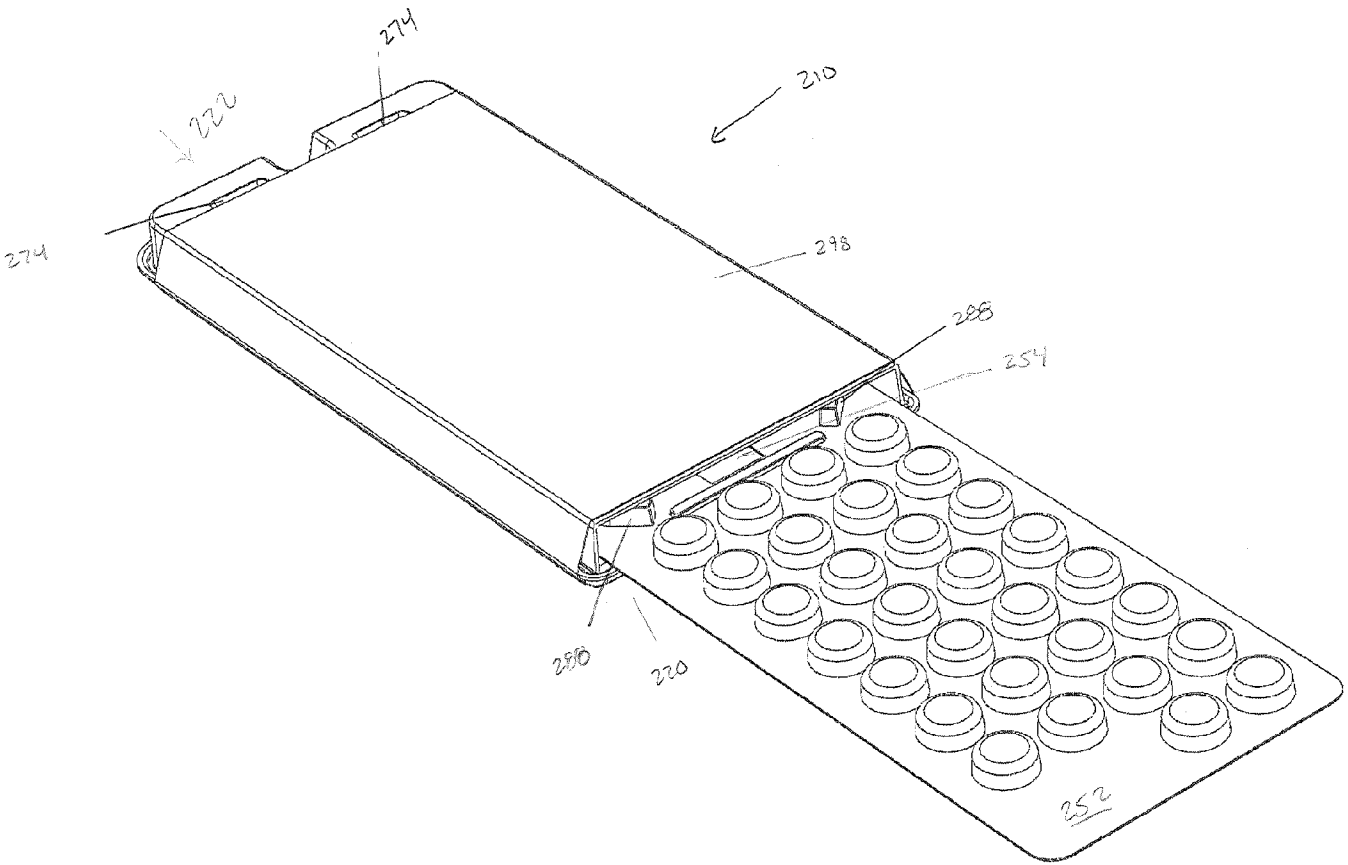
FIG. 26 is a perspective bottom view of the two-piece container of FIG. 25, showing the insert card in the open or withdrawn position and further showing an outer sleeve disposed around the container.
Figure 29:
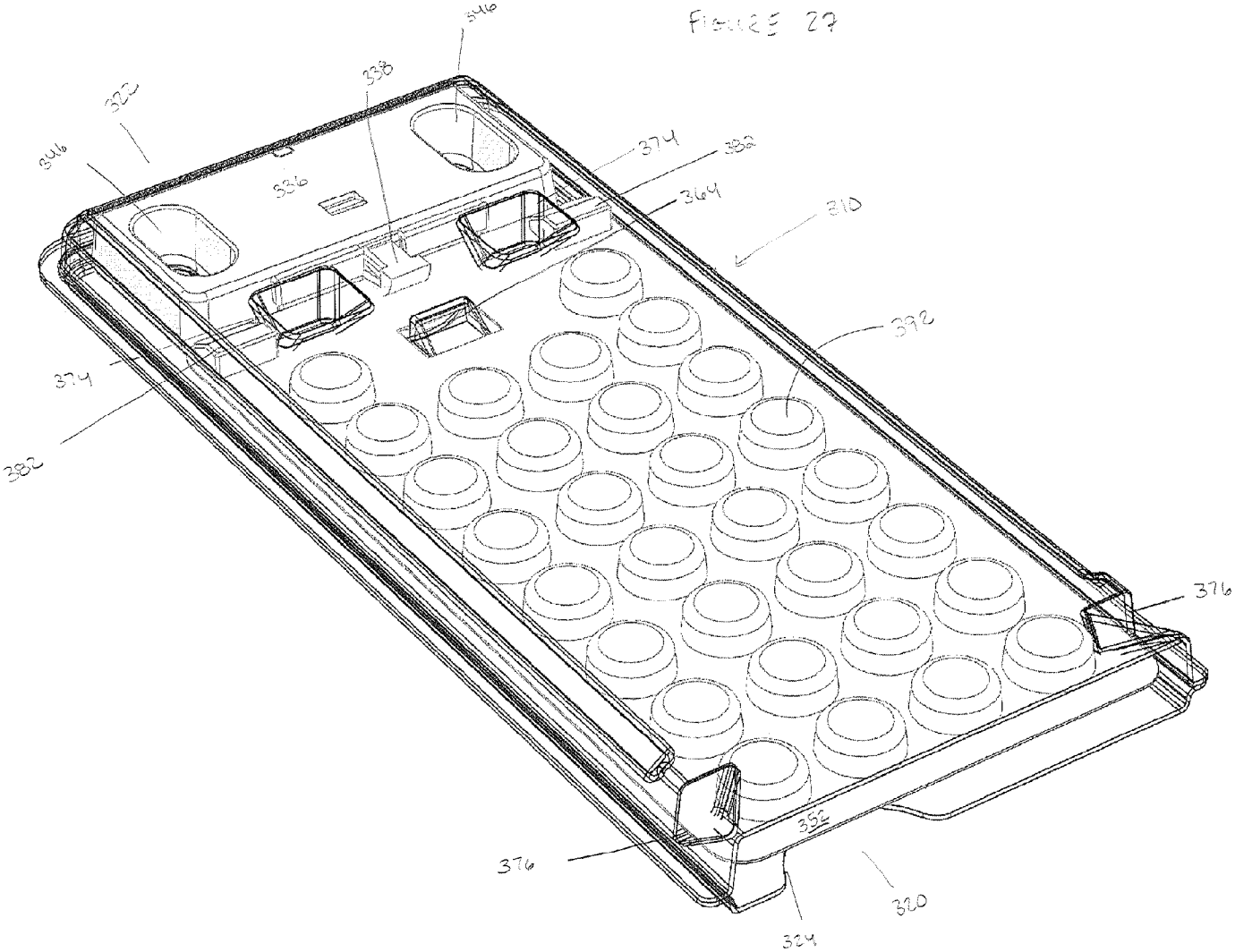
FIG. 29 is an exploded perspective view of the two-piece container of FIG. 27.
Figure 28:
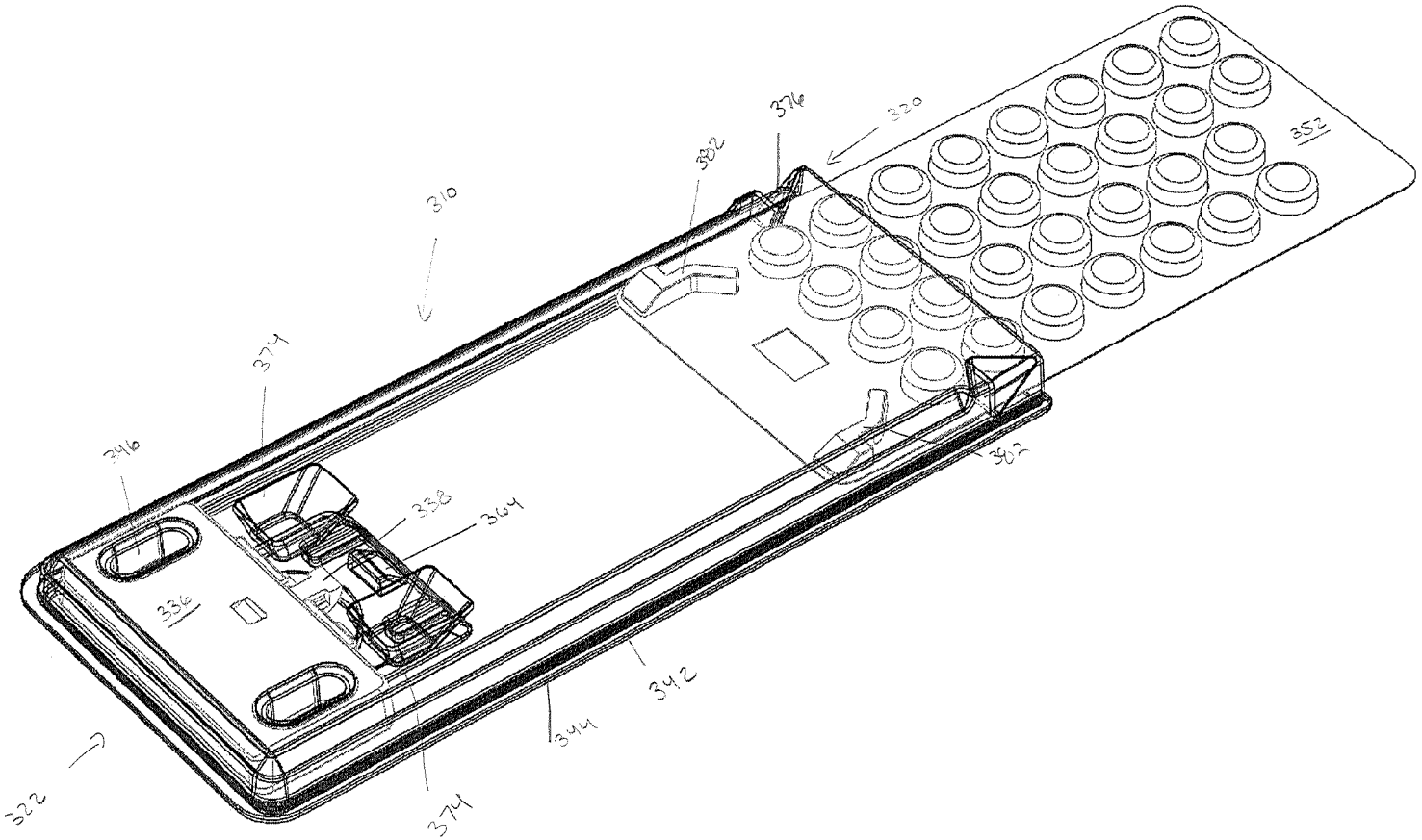
FIG. 28 is a perspective view of the two-piece container of FIG. 27 with the insert card in an open or withdrawn position.
Figure 29:
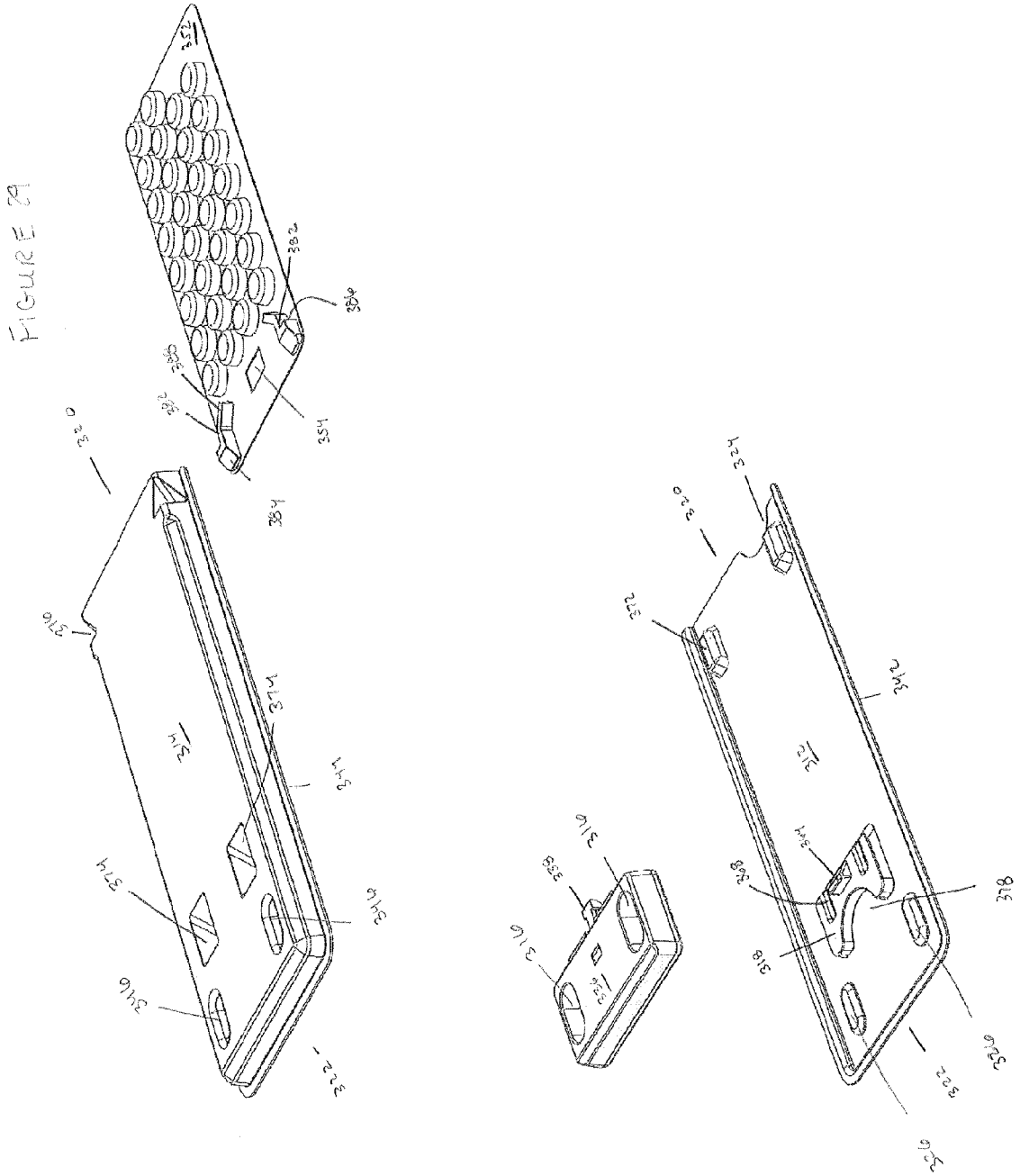
Figure 3D:
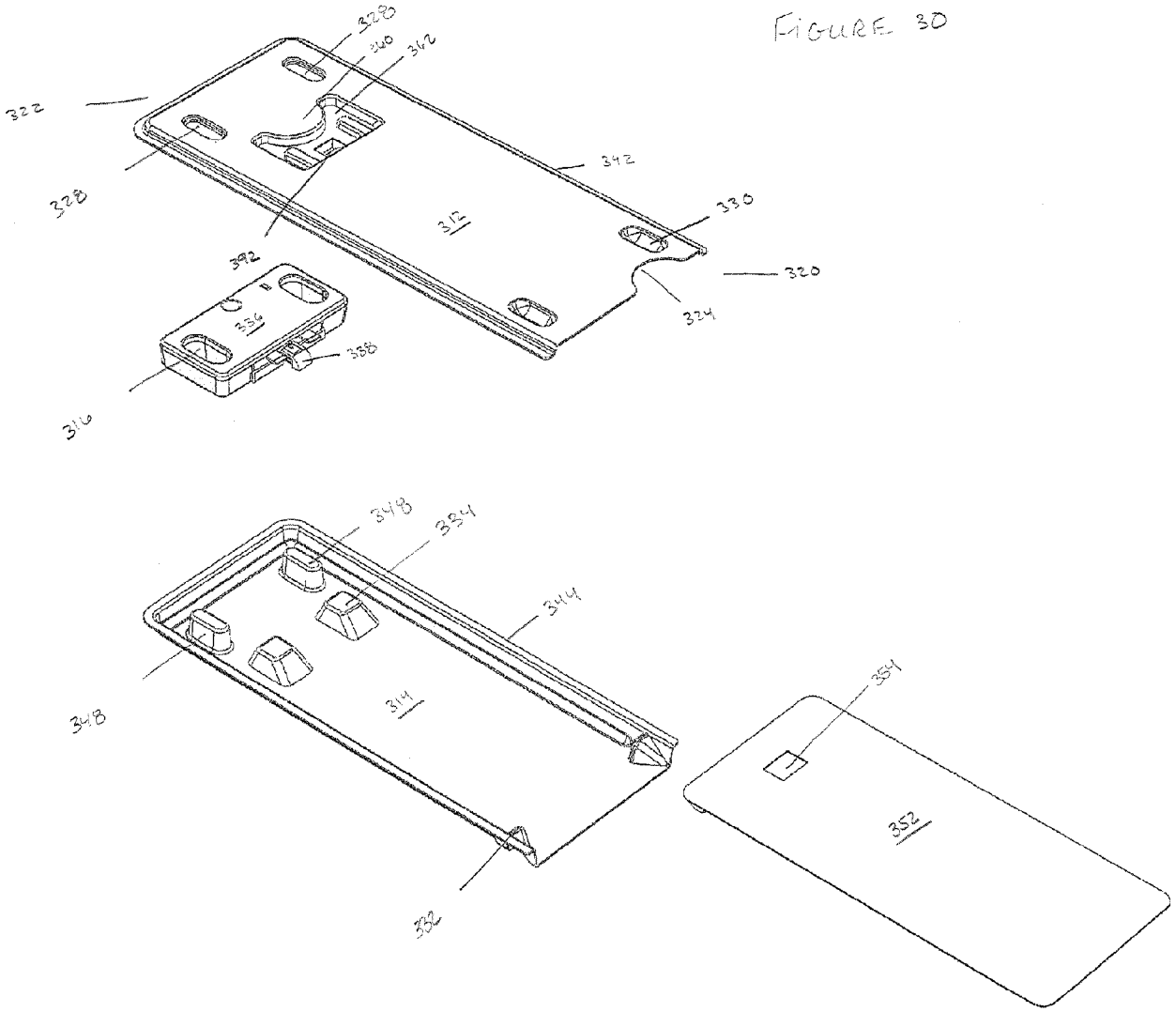

FIGS. 19-26 illustrate a container 210 having a top piece 212 attached to a bottom piece 214 to form an outer shell 210 with an open end 220 and a closed end 222 and a cavity in between that may house one or more insert card(s) 252 wherein the one or more insert cards 252 may have one or more product cavities contained therein. Top 212 and bottom 214 of container 210 may be joined together at edge lines 242 and 244 using adhesive, snaps, sealing methods, an outer wrap such as a film, shrink film, paper, or plastic, or other such methods. Manufacturing preferences will dictate the best means of joining the two or more pieces together. It is to be understood that some or all of the outer wrap may be clear or transparent. It is to be understood that the outer wrap may be covered in advertising. It is to be understood that the outer wrap may be a paperboard sleeve 298 that may or may not be used to hold the one or more pieces of container 210 together as shown in FIG. 26. It is to be understood the edge lines 242 and 244 may overlap when joined together or may be sealed along a flange if manufacturing preferences dictate.

Container 210 may have one or more locking elements 264 located on one or more of the top 212 and/or the bottom 214. The one or more locking elements may have one or more reinforcing elements 266 nearby to improve its function. Container 210 may have one or more release button(s) or unlocking area(s) 260 that may be approximately adjacent to the locking element 264 such that pressure in unlocking area 260 will effect the relationship between the locking element 264 on the outer shell and the insert card locking element 254 on the insert card 252 in such a manner that the insert card 252 is able to slide within the cavity of the outer sleeve or outer shell 210 from a closed position fully contained within the outer sleeve to an open position with insert card 252 at least partially extending outside of the open end 220 of the outer sleeve 210. It is to be understood that the one or more unlocking area(s) 260 may be perforated, cut or in a weakened area along its front edge, which may be curved, in area 262 such that flexibility of unlocking area 260 is increased. It is to be understood that the one or more unlocking area(s) 260 may be positioned on one or more sides of the container 210 such that pressure in these areas will effect the relationship between the locking element 264 on the outer shell and the insert card locking element 254 on the insert card 252 in such a manner that the insert card 252 is able to slide within the cavity of the outer sleeve or outer shell 210 from a closed position fully contained within the outer sleeve 210 to an open position with insert card 252 at least partially extending outside of the open end 220 of the outer sleeve 210.

One or more sides of the two piece structure 210 may have one or more locking ramps 234 that act to ensure that the locking elements 264 on the outer sleeve 210 and the locking elements 254 on the inner card 252 interact and lock the inner card 252 within the cavity of the outer sleeve. It is to be understood guide rails or alternative elements on the inner walls of the outer shell may be provided instead of or in addition to locking ramps 234 to ensure that the inner card 252 aligns properly within outer sleeve 210 such that the insert card locking element 254 may align with outer sleeve 210 locking element 264. It is also to be understood that child-resistant deactivating features may be added to the outer sleeve 210 and/or the insert card 252 such that a user or pharmacist can prevent the insert card locking element 254 from interacting with the outer sleeve locking element 264. Such deactivation features may be as simple as a flap on the outer sleeve 210 and/or insert card 252 that may be folded in a manner that interferes with the outer sleeve locking element 264 from catching on the insert card locking element 254.

Outer sleeve 210 may have one or more user indicator(s) 236 that may make a noise when the user depresses unlocking element 260. The inner side 294 of the user indicator 236 may at least partially align with the inner edge 278 the unlocking element 260. Furthermore user indicator 236 may be made of a thinner wall structure, stepped wall structure, or other such design such that pressure placed on unlocking element 260 pushed inner edge 278 into inner edge 294 of the user indicator and at least partially collapses the user indicator such that a noise is omitted. It is to be understood that manufacturing preferences may indicate the appropriate structural design for user indicator 236 such that it is capable of emitting a noise as well as returning mostly if not completely to its original structural shape upon the release of pressure on unlocking element 260.

Outer sleeve 210 may also have retention features on the top 212 and/or the bottom 214 piece. Outer sleeve 210 may have one or more retaining edge(s) 232 that catch on the one or more retaining element(s) 282 on the insert card. Retaining element 282 on the insert card 252 may have one or more angled or sloped leading edge(s) 284 that may increase ease in loading the insert card into the container 210. Leading edge 284 may slide under outer sleeve front retaining edge 276 whereas a straight non-angled edge may be harder to load into the cavity of the outer sleeve. In addition, sloped leading edge 284 may assist an insert card 252 made of flexible material in bending or flexing slightly and thus allowing the card to slide into the package more easily and adjust around the retention features at the front end 220 of container 210. In addition one or more guide ramps 234 may help the inner card 252 stay in place and maintain the proper position both in loading and in sliding from an open to closed position or the reverse. Guide ramps 272 may also help retain the insert card 252 within the container 210 and not allowing it to be fully removed from the container 210 by maintaining the end of the insert card 252 in proper orientation to the corresponding retention elements 232 on the inside of container 210. The one or more guide ramps 234 and the one or more retaining edges 232 may be on opposite ends of the container 210, e.g. guide ramps 234 may be relatively closer to the closed end 222 of container 210 and retaining edge 232 may be relatively closer to the open end 220 of container 210. Additional guide ramps 272 may be positioned closer to the open end 220 of the container 210 on top 212 and located approximate to retaining edge 232 on bottom 214 near open end 220 of container 210.

Retaining element 282 of the insert card 252 may also have a straight edge 286 that once insert card 252 is loaded into container 210 straight edge 286 may catch on retaining edges 232 making the insert card difficult to fully remove from container 210. It is to be understood a variety of other structural designs may be employed on both the blister card and the outer sleeve to retain the insert card within the package. These may include but are not limited to, one or more ledge(s), bumps, ramps, holes, or flaps on the interior side of the container near the open end that catch flap(s) or bumps or ramps or ledges or feet or holes etc on the insert card. Retaining element 282 may also have angled arm 288 that assists the insert card in properly aligning itself in the back 222 end of the container near locking element 264 by sliding around guide elements 234.

It is to be understood that although a two piece structure is discussed above these same features described herein may be a part of a single piece structure as well. It is also to be noted that whether a single piece structure or a two piece structure is used the inner features of the container may be the exact structural opposites of the external features of the container, e.g. a cavity on the inside equals a raised area on the outside or the reverse. For example, raised locking element 264 on the inner side of the container mirrors cavity 292 on the exterior of container 210. This is noted with other elements as well including but not limited to: guide elements 272 in the interior of container 210 mirrors cavity 230 on the exterior; guide elements 234 on the interior of container 210 mirrors cavity 274 on the exterior of the container 210; inner edge 294 of the user indicator on the interior of container 210 mirrors cavity 236 on the exterior of the container 210; cavity 278 on the interior of container 210 mirrors raised unlocking area 260 on the exterior of the container 210; reinforcing element cavities 268 on the interior of container 210 mirrors raised reinforcing elements 266 on the exterior of container 210; raised area 218 on the interior of container 210 corresponds to cavity 262 in front of unlocking area 260 on the exterior of container 210.

FIGS. 27-30 illustrate an example of a one or two piece container 310 of the present invention having an electronic component 336 that interacts with insert card 352 at arm 338. As described previously, in a two piece design top 312 and bottom 314 of container 310 may be joined together at edge lines 342 and 344 using adhesive, snaps, sealing methods, an outer wrap such as a film, shrink film, paper, or plastic, or other such means/methods. Top 312 and bottom 314 of container 310 may overlap at edge lines 342 and 344 and be joined together using any of the means/methods described above. It is to be understood that many of the other features of container 310 have been described in the previous embodiments as well.

It is to be understood that insert card 352 may have a notch or slot of other embossed, debossed or cut/out area to allow it to align with electronic component arm 338 or it may simple slide into a slot within arm 338 or interact in any other means possible to show that insert card 352 is inserted and/or removed from arm 338 and container 310. Arm 338 should be positioned such that upon full insertion of insert card 352 into container 310 insert card 352 also interacts with arm 338 in such a manner that it recognizes insert card 352 is in a fully closed position. Furthermore arm 338 should be positioned such that when insert card 352 is partially removed in such a way that a user may access the one or more product cavities contained therein, insert card 352 should be removed from arm 338 such that electronic component 336 may register that insert card 352 has been removed from container 310 and the user has access to the product cavities contained therein. It is to be understood that a variety of electronic components capable of counting blister or insert card removal and replacement or determining package weight or other such adherence calculations exist in the industry and any of these could be adjusted to fit the container described herein. In the current design, the electronic component 336 is molded or formed to snap fit to the top 312 on one or more bumps 326 and/or to the bottom on one or more bumps 348. As described before each of these internal bumps may have a corresponding cavity on the external side of the container respectively 328 and 346. Electronic component 336 may have one or more cavities 316 included therein to align with and lock in place with one or more bumps 326 and 348. It is to be understood that other means of attaching an electronic component to container 310 may be used such as adhesive, welding, snapping in place, etc.

Figure 31:
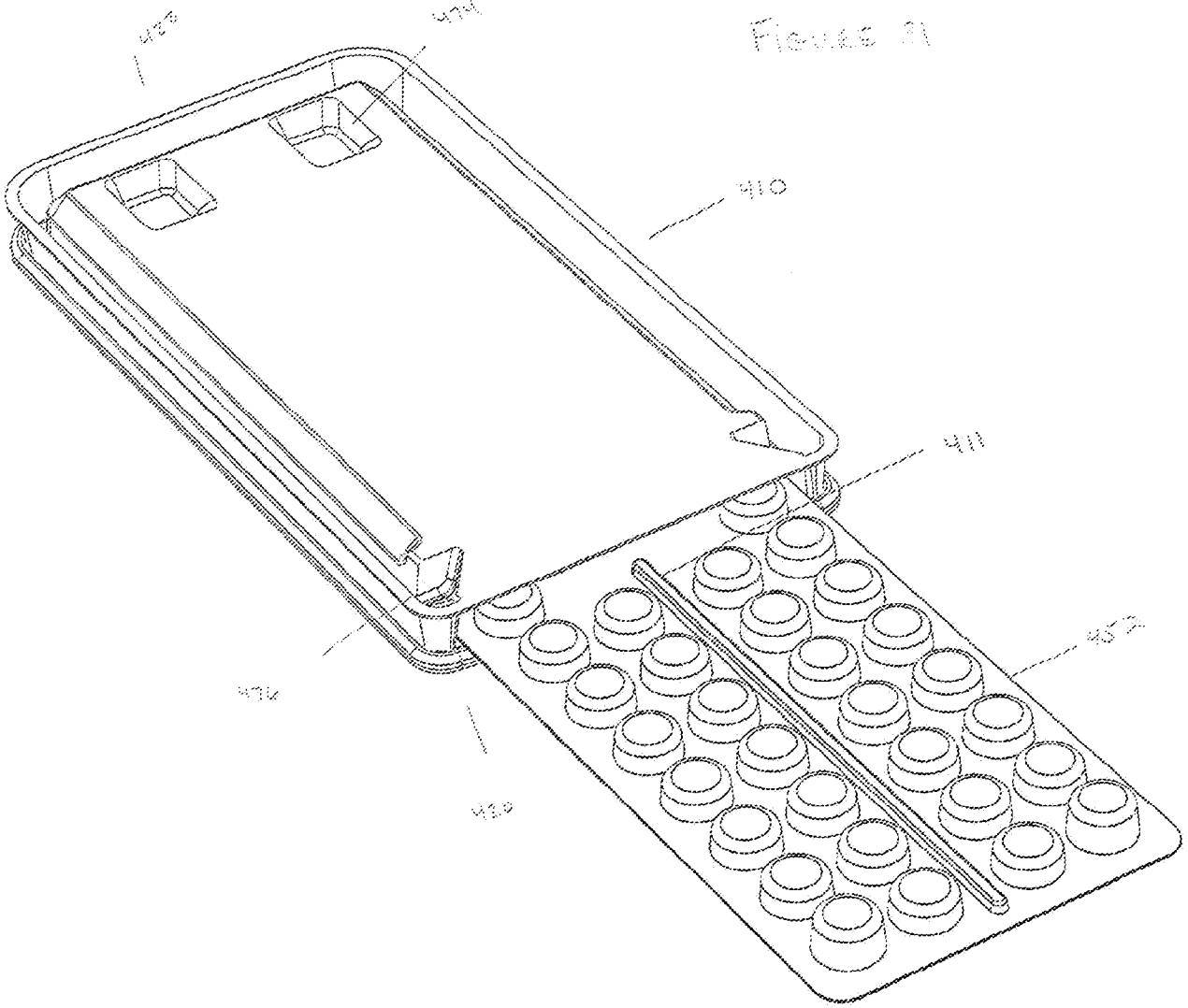
FIG. 31 is a perspective view of an alternate form of the container in its assembled form.
Figure 34:
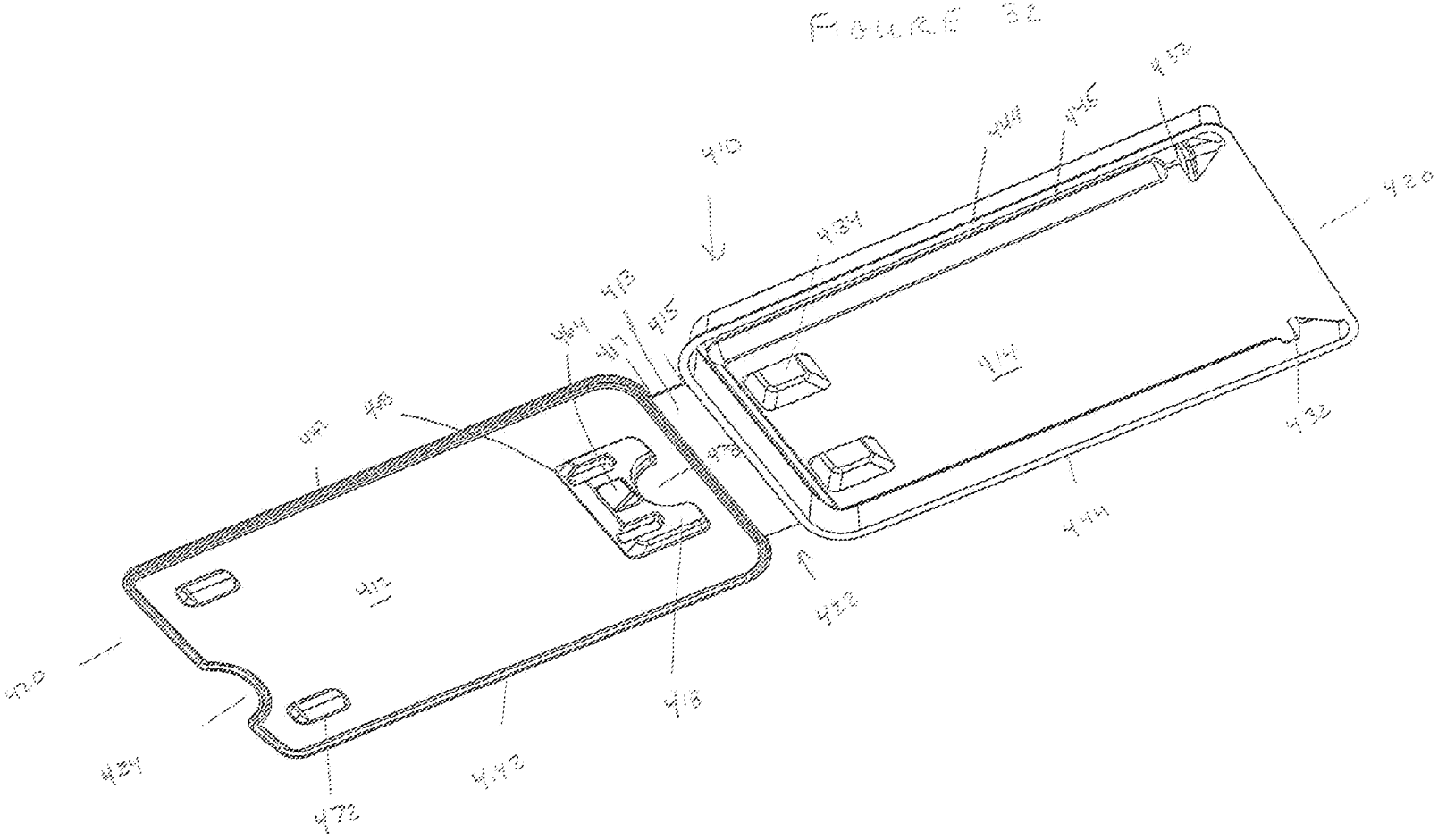
FIG. 34 is an exploded perspective view, partially cutaway, of the container of FIG. 31, showing a transverse cross section of that container.
Figure 29:
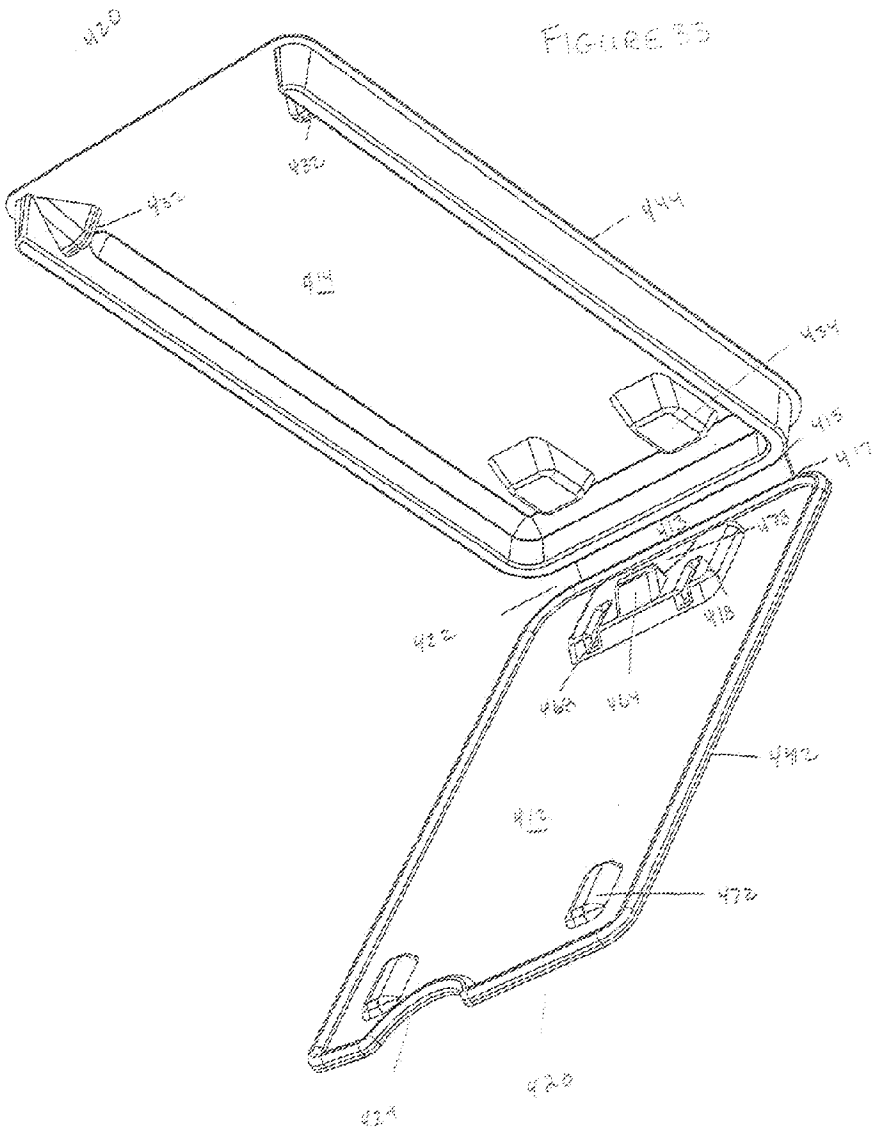
Figure 22E:
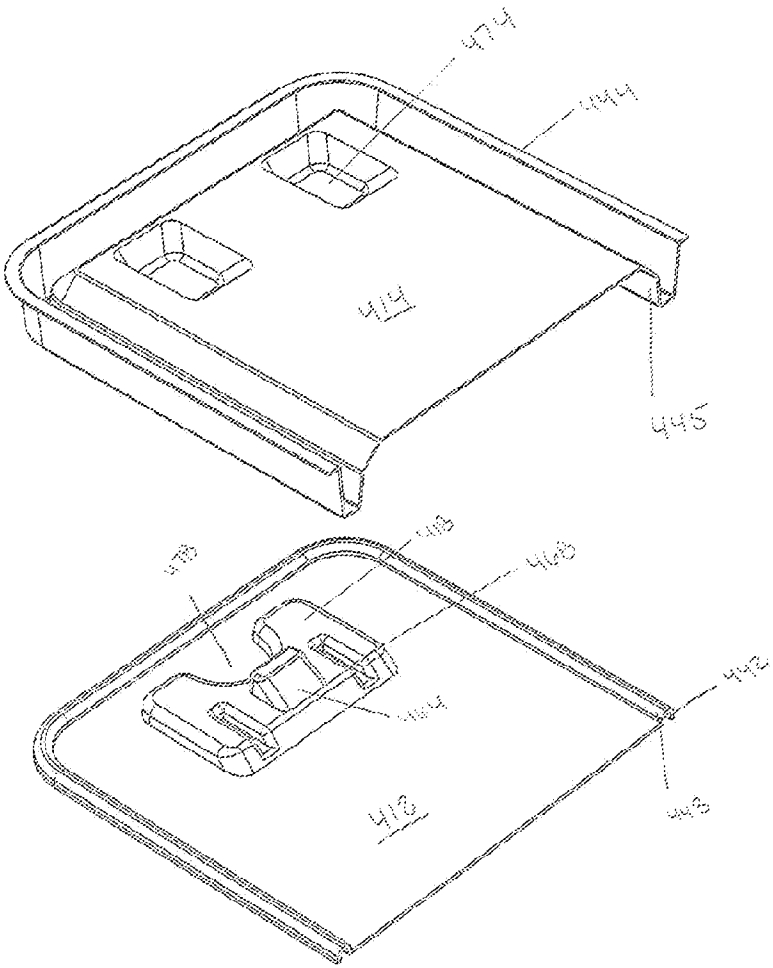
Figure 35:
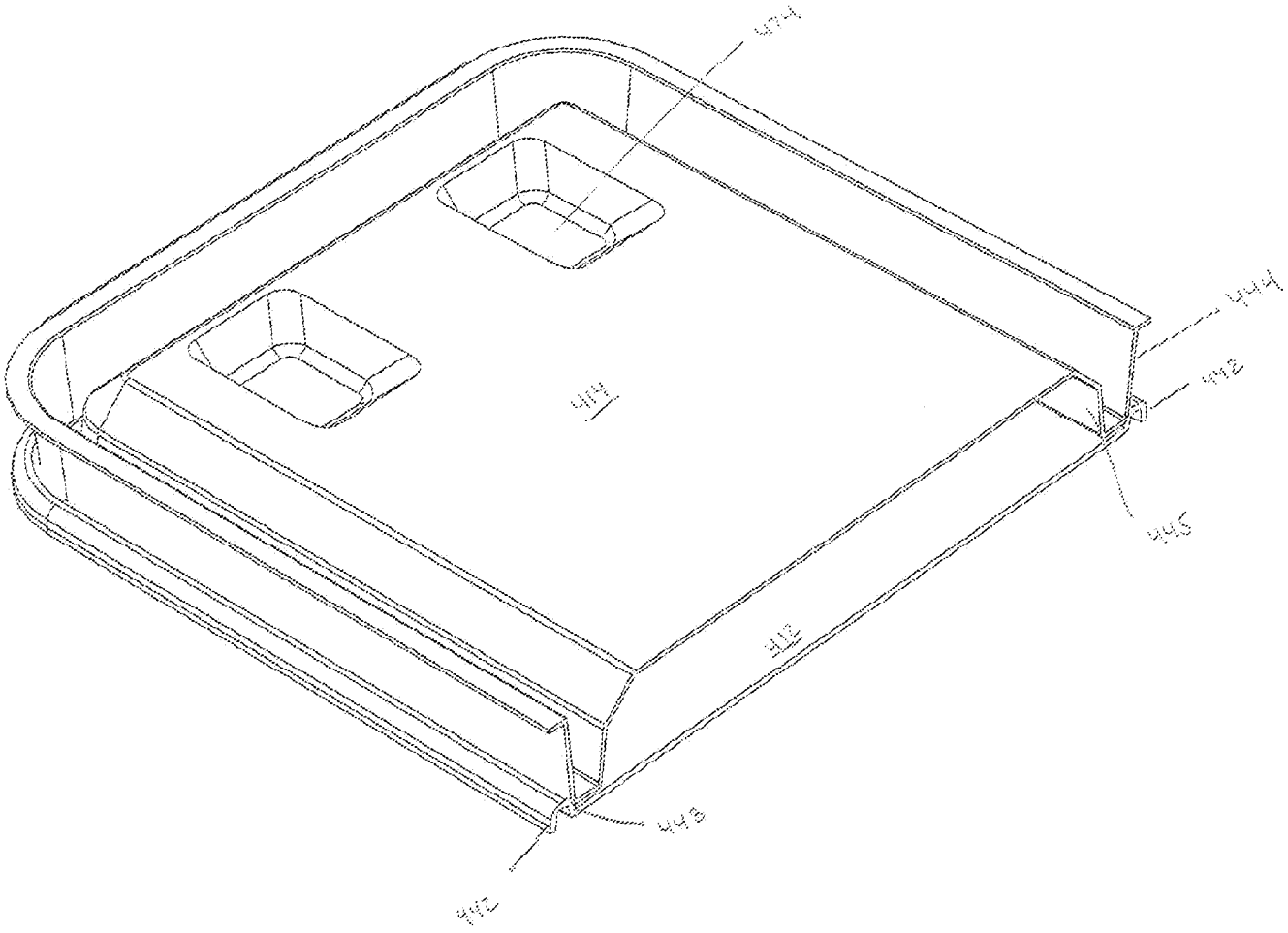
FIG. 35 is a perspective view, partially cutaway, of the container of FIG. 34 in an assembled form, showing a transverse cross section of the bottom side of the container.

FIG. 31 illustrates an alternate insert card layout having a central guide rail 411 running down the center of the insert card 452. Embossing or debossing on the interior of the container cavity may help insert card 452 retain its proper position within container 410. It is to be understood that embossing debossing or formed channels, cavities, ridges, bumps etc. in outer shell 10, 210, 310, or 410 may assist the insert card 90, 252, 352, 452 in maintaining its correct positioning within container 10, 210, 310, 410. It is to be understood that a variety of ramps and guide elements may be used to maintain proper alignment of the insert card 90, 252, 352, 452 functional elements for locking and retention and the outer sleeves 10, 210, 310, 410 functional elements for locking and retention.

FIGS. 32-35 illustrate an alternate form for the outer sleeve 410 having a spine portion 413 attached at fold line 417 to top portion 412 and attached at fold line 415 to bottom portion 414. In its fully assembled position, spine 413 forms closed end 422 and top side 442 attaches to bottom side 444. It is to be understood sides 442 and 444 may snap together, may be adhered together, may be held together with shrink film, tape, welding, heat sealing, staples, adhesive outer wrap material or any other such attachment method. It is to be understood that the foregoing elements discussed in the other embodiments may be used in this embodiment as well.

Sides 444 may have a u-shaped wall structure or bent double wall structure with inner wall 445 bending towards the outer edge of container 410 before bending downward to form side 444 the exterior wall of container 410. Because inner wall 445 is formed and bends to form side wall 444 bottom 414 may be die cut along the same plane as the front (open) end 420. Accordingly, a simple die cutting process may be used to cut out the formed or molded structure. It is to be understood that this U-shaped double side wall technique may be used on the two piece designs discussed previously and/or on the single piece design depicted herein and/or described previously. Additionally, it is to be understood that the u-shaped double side wall structure way be used side 442 of top 412 should manufacturing preferences dictate and/or on bottom 414 should manufacturing preferences dictate. Side 442 may extend from inner side was 443 and form a similar u-shaped structure. When sides 442 and 444 are fitted together it is to be understood that their respective u-shaped structures may be designed to fit together or snap together.

The material used to create the container 10, 210, 310, 410, 510 disclosed in these embodiments may be a thin plastic. It may be blow molded, vacuum formed, thermoformed, or even injection molded. The wall thickness may range from 12,000ths of an inch to 40,000ths of an inch. It is to be understood the forming technique may affect the wall thickness with injection molded pieces having greater thickness. A wall thickness of less than 40,000ths of an inch will be lighter in weight and use less material than the current plastic containers on the market. The wall thickness may range from 25,000ths of an inch to 38,000ths of an inch, from 20,000ths of an inch to 30,000ths of an inch from 12,000ths of an inch to 20,000ths of an inch. Recycled plastic may also be used for these containers. It is to be noted that while ribs, posts and other embossments may be added to these containers, the simplistic designs/embodiments disclosed herein do not require them to function and in fact removing posts and ribs and using the mirrored surface described herein instead reduces the amount of material needed to create the container.

Clear, transparent or translucent material may be used for these containers. The material may be treated with UV protection to help preserve medications or other such treatments. Having a clear, translucent or transparent material may allow the user to view the content of the container as well as any instructions or communications without having to open the container or slide out the blister. This is of particular importance in any adherence calculating containers.

It should be readily understood that in the foregoing first embodiment, locking element 40 and insert card flap 95 may interact such that a portion of the interaction occurs outside of the container 10. For example, locking element 40 may be an opening that insert card flap 95 may extend through. To open, the user may need to push the insert card flap 95 into the container such that it slides under the locking element 40.

It is believed that the present invention includes many other embodiments that may not be herein described in detail, but would nonetheless be appreciated by those skilled in the art from the disclosures made. Accordingly, this disclosure should not be read as being limited only to the foregoing examples or only to the designated embodiments.

The invention claimed is:

1. A package comprising:

at least one insert card; and a container comprising:

a sleeve structure having an interior chamber in which the at least one insert card is received;

one or more locking elements disposed in the sleeve structure to lock the at least one insert card within the interior chamber such that the at least one insert card cannot be removed without being disengaged from the one or more locking elements;

an unlocking area positioned adjacent to the one or more locking elements such that pressure on the unlocking area unlocks the insert card to be at least partly removable from the interior chamber;

wherein the unlocking area is defined on the sleeve structure by an outline extending all the way around the unlocking area, the outline being entirely curved, the unlocking area being contiguous with the remainder of the sleeve structure along every part of the outline; and wherein said pressure on the unlocking area moves the unlocking area uniformly inward toward the interior chamber.

2. The package of claim 1, wherein the sleeve structure has a closed end, and the one or more locking elements comprise:

one or more locking stop elements generally positioned near the closed end of the sleeve structure;

at least one locking guide that indents from a top of the sleeve structure into the interior chamber;

an indented support platform that indents from a bottom of the sleeve structure into the interior chamber; and wherein the sleeve structure has a length along a sleeve axis of the sleeve structure, wherein the unlocking area is positioned lengthwise between the one or more locking stop elements and the closed end of the sleeve structure, and wherein downward force applied to the unlocking area will cause the deflection of the at least one locking guide further into the interior chamber of the container.

3. The package of claim 2, wherein the sleeve structure further comprises:

at least one retaining element that slopes inward and rearward from the internal surface of the top of the sleeve structure into the interior chamber and then vertically back to the internal surface of the top of the sleeve structure, the retaining element being generally positioned near an open end of the sleeve structure opposite to the closed end and against one side with respect to the width of the sleeve structure.

4. The package of claim 1, wherein the one or more locking elements comprise:

one or more locking stop elements generally positioned near a closed end of the sleeve structure;

at least one locking guide that indents from an external surface of a top of the sleeve structure into the interior chamber; and an indented support platform that indents from an external surface of a bottom of the sleeve structure into the interior chamber, wherein the unlocking area is defined on the top of the sleeve structure, and wherein inward force applied to the unlocking area will cause the deflection of the sleeve structure above an insert card flap of the at least one insert card.

5. The package of claim 1, wherein the outline is circular.

6. The package of claim 1, wherein the unlocking area is continuous at an end thereof adjacent to the one or more locking elements with the remainder of the sleeve structure.

7. The package of claim 6, wherein the unlocking area at the end is contiguous with the remainder of the sleeve structure.

8. The package of claim 6, wherein the unlocking area is defined on a top of the sleeve structure, the unlocking area is continuous at the end with the remainder of the top of the sleeve structure.

9. The package of claim 8, wherein the unlocking area at the end is contiguous with the remainder of the top of the sleeve structure.

10. The package of claim 9, wherein the top of the sleeve is a closed surface, wherein the unlocking area is independent and separate from the one or more locking elements and wherein the one or more locking elements are disposed between the unlocking area and an open end of the sleeve structure.

11. A package comprising:

at least one insert card; and a container comprising:

a sleeve structure having an interior chamber in which the at least one insert card is received;

one or more locking elements disposed in the sleeve structure to lock the at least one insert card within the interior chamber such that the at least one insert card cannot be removed without being disengaged from the one or more locking elements;

an unlocking area positioned adjacent to the one or more locking elements such that pressure on the unlocking area unlocks the insert card to be at least partly removable from the interior chamber;

wherein the unlocking area is defined on the sleeve structure by an outline extending all the way around the unlocking area, the unlocking area being contiguous with the remainder of the sleeve structure along every part of the outline;

wherein the unlocking area is formed in at least one of a top of the sleeve structure and a bottom of the sleeve structure, and at least a portion of the unlocking area is curved out of the plane of the at least one of the top and bottom, wherein the at least one of the top and bottom is a closed surface, wherein the unlocking area is a separate element from the one or more locking elements; and wherein the one or more locking elements are disposed between the unlocking area and an open end of the sleeve structure.

12. A package comprising:

at least one insert card; and a container comprising:

a sleeve structure having an interior chamber in which the at least one insert card is received;

one or more locking elements disposed in the sleeve structure to lock the at least one insert card within the interior chamber such that the at least one insert card cannot be removed without being disengaged from the one or more locking elements;

an unlocking area positioned adjacent to the one or more locking elements such that pressure on the unlocking area unlocks the insert card to be at least partly removable from the interior chamber;

wherein the unlocking area is defined on the sleeve structure by an outline extending all the way around the unlocking area, the unlocking area being contiguous with the remainder of the sleeve structure along every part of the outline; and wherein the unlocking area is curved as viewed in a cross section thereof.

13. The package of claim 12, wherein the unlocking area is arched outward of the interior chamber as viewed in the cross section.

* * * * *